US007850480B2

(12) United States Patent
Takanashi et al.

(10) Patent No.: US 7,850,480 B2
(45) Date of Patent: Dec. 14, 2010

(54) CONNECTOR MOUNTING STRUCTURE

(75) Inventors: Hitoshi Takanashi, Yokkaichi (JP); Takafumi Sakamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 107 days.

(21) Appl. No.: 12/277,540

(22) Filed: Nov. 25, 2008

(65) Prior Publication Data

US 2009/0137143 A1 May 28, 2009

(30) Foreign Application Priority Data

Nov. 26, 2007 (JP) ..... 2007-304823
Jan. 8, 2008 (JP) ..... 2008-001301

(51) Int. Cl.
*H01R 13/64* (2006.01)

(52) U.S. Cl. ..... 439/376

(58) Field of Classification Search ..... 439/374, 439/246–248, 376
See application file for complete search history.

(56) References Cited

U.S. PATENT DOCUMENTS 1,927,316 A * 9/1933 Katzman ..... 439/374
4,946,394 A * 8/1990 Knapp et al. ..... 439/157
6,196,856 B1 3/2001 De Villeroche
6,878,001 B2 4/2005 Nishide
7,189,101 B2 3/2007 Nagashima et al.
2006/0223383 A1 10/2006 Kobayashi et al.

FOREIGN PATENT DOCUMENTS

EP 0549386 6/1993
EP 1557911 7/2005

* cited by examiner

*Primary Examiner*—Briggitte R Hammond
(74) *Attorney, Agent, or Firm*—Gerald E. Hespos; Michael J. Porco

(57) ABSTRACT

An electrical component (1) includes a bracket (30) and a connector (10) that is mountable to a mount hole (R2) of a casing (R). The bracket (30) prevents loose movements of the connector (10) until immediately before the connector (10) is mounted into the mount hole (R2) while permitting loose movements of the connector (10) in the course of mounting the connector (10) into the mount hole (R2).

14 Claims, 18 Drawing Sheets

CONNECTOR MOUNTING STRUCTURE

BACKGROUND OF THE INVENTION

1. Field of the Invention

The invention relates to a connector mounting structure for mounting a connector at a specified mounting position of a mating member.

2. Description of the Related Art

An electrical component used, for example, in an automatic transmission or the like of an automotive vehicle includes a connector and a support for loosely movably supporting the connector. The connector is mounted at a specified mounting position of a mating member by assembling the electrical component with the mating member (see, for example, U.S. Pat. No. 7,189,101). An operation of mounting such an electrical component needs to be performed carefully so that an axial center position of the connector is not displaced from the specified mounting position. In this regard, since the connector is supported for loose movement relative to the support in the above-described electrical component, the mounting operation can be performed while the axial center of the connector is held at a specified position by absorbing the displacement.

The constant loose movable support of the connector relative to the support in the above-described electrical component, complicates efforts to align the connector with the specified mounting position before mounting the connector at the specified position. However, if the connector is fixed so as not to be loosely movable relative to the supporting member, there is a likelihood that an excessive force is exerted to the connector since no displacement of the connector is permitted in the course of mounting the connector.

Furthermore, since the connector is supported to be loosely movable relative to the bracket in the above-described connector mounting structure, the connector is likely to incline with respect to a proper mounting direction before the mounting of the connector is started. Therefore it is difficult to direct the axial center of the connector towards the mounting hole. On the contrary, if loose movements of the connector relative to the bracket are prevented, a mounting position cannot be adjusted finely upon mounting another part on the bracket after mounting the connector. Thus, it is desirable for the bracket to be loosely movable relative to the connector to enable a fine adjustment of the mounting position after the connector is mounted into the mount hole.

The present invention was developed in view of the above situation and an object thereof is to improve overall operability of an operation of mounting a connector at a specified position.

SUMMARY OF THE INVENTION

The invention relates to a connector mounting structure for mounting a connector at a specified position of a mating member by assembling an electrical component including the connector and at lest one support loosely movably supporting the connector into the mating member. The support prevents loose movements of the connector until immediately before the connector is mounted at the specified mounting position while permitting loose movements of the connector in the course of mounting the connector at the specified position. Accordingly, the connector can be aligned more easily with the specified mounting position, and there is no likelihood of displacing the axial center position of the connector with respect to the specified mounting position. Therefore, the connector can be mounted easily at the specified mounting position.

The support may include at least one mounting piece insertable into an insertion groove formed in the connector in a Z-direction, where the Z-direction is defined as a mounting direction of the connector towards the specified mounting position. Additionally, the support may support the connector so that the connector is movable between a restricted position where loose movements of the connector are prevented and a permitted position where loose movements of the connector are permitted. Accordingly, the mounting direction of the connector and the inserting direction of the mounting piece coincide. Thus, the connector can be mounted at the specified mounting position following an operation of inserting the mounting piece into the insertion groove.

A surrounding wall forming at least part of the insertion groove may include an X-direction restricting wall that can contact one or both opposite sides of the mounting piece in an X-direction at the restricted position, where the X-direction is defined as intersecting with the Z-direction, and preferably is a plate surface direction of the mounting piece. Accordingly, the connector cannot move in the X-direction when the connector is at the restricted position.

A surrounding wall that forms at least part of the insertion groove may include a Y-direction restricting wall that can contact one or both of the substantially opposite sides of the mounting piece in a Y-direction at the restricted position. The Y-direction is defined to be a plate surface direction of the mounting piece. Accordingly, the connector cannot move in the Y-direction when the connector is at the restricted position.

The connector may include at least one lock displaceable in a plate surface direction of the mounting piece, and the mounting piece may include a first retaining portion for retaining the connector in the Z-direction by engaging the lock at the restricted position and a second retaining portion for engaging the lock at the permitted position and retaining the connector in the Z-direction while permitting loose movements of the connector. Accordingly, the lock can be engaged with the first retaining portion to retain the connector in the Z-direction when the connector is at the restricted position. On the other hand, the lock can engage the second retaining portion to retain the connector in the Z-direction while permitting loose movements of the connector when the connector is located at the permitted position.

The connector mounting structure preferably includes a support loosely movably supporting the connector in the mating member. The support preferably includes inclination preventing portions to be brought into contact with the connector at contact portions. The inclination preventing portions permit the connector to move in a direction along a plane intersecting the Z-axis while preventing the axial center of the connector from being inclined with respect to the Z-axis. Accordingly, a connector is permitted to move in a direction intersecting a proper mounting direction while preventing the connector from being inclined with respect to the proper mounting direction, thus improving overall mounting operability of a connector.

The inclination preventing portions preferably are spaced apart in a direction intersecting a direction connecting the contact portions. Thus, the inclination of the connector with respect to a proper mounting direction is prevented. Accordingly, the axial center of the connector is directed easily toward the specified mounting position and to align the connector with the specified mounting position. The support can be moved relative to the connector in the direction intersecting with the proper mounting position after the connector is mounted at the specified mounting position. Therefore, a mounting position can be adjusted finely when mounting another part on the support.

The support may include a at least one mounting piece loosely movably supporting the connector and restricting pieces arranged at the mounting piece to face each other at substantially opposite sides of the mounting piece.

The inclination preventing portions may be provided at leading-end edges of the restricting pieces and are defined by leading-end outer peripheral edges of the restricting pieces and the outer circumferential surfaces of projections projecting sideways from the leading-end edges of the restricting pieces.

The connector may include contact surfaces that can come contact the leading-end outer peripheral edges of the restricting pieces. Resilient pieces project from the corresponding contact surfaces and are arranged to face the corresponding restricting pieces. Restricting holes penetrate the corresponding resilient pieces and have inner circumferential surfaces that can contact the outer circumferential surfaces of the corresponding projections.

According to such a construction, the inclination of the connector is prevented by the contact of the leading-end outer peripheral edges of the restricting pieces of the support with the contact surfaces of the connector and the contact of the outer circumferential surfaces of the projections of the restricting pieces of the support with the inner circumferential surfaces of the restricting holes of the resilient pieces of the connector.

The connector may be movable in width directions relative to the support between a proper position and an end position. Thus, one of the inner circumferential surfaces of the restricting holes may not be in contact with the outer circumferential surface of the corresponding projection when the connector is at the end position. Furthermore, auxiliary projections may be provided at the substantially opposite widthwise sides for contacting the leading-end outer peripheral edge of the restricting piece instead of the inner circumferential surface of the one restricting hole.

If the connector is moved from the proper position to the end position in such a construction, the one of the inner circumferential surfaces of the restricting pieces is not held in contact with the outer circumferential surface of the corresponding projection. However, the auxiliary projection contacts the leading-end outer peripheral edge of the restricting piece instead. Therefore, inclination of the connector is prevented. Accordingly, a connector is permitted to move in a direction intersecting with a proper mounting direction while being prevented from being inclined with respect to the proper mounting direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
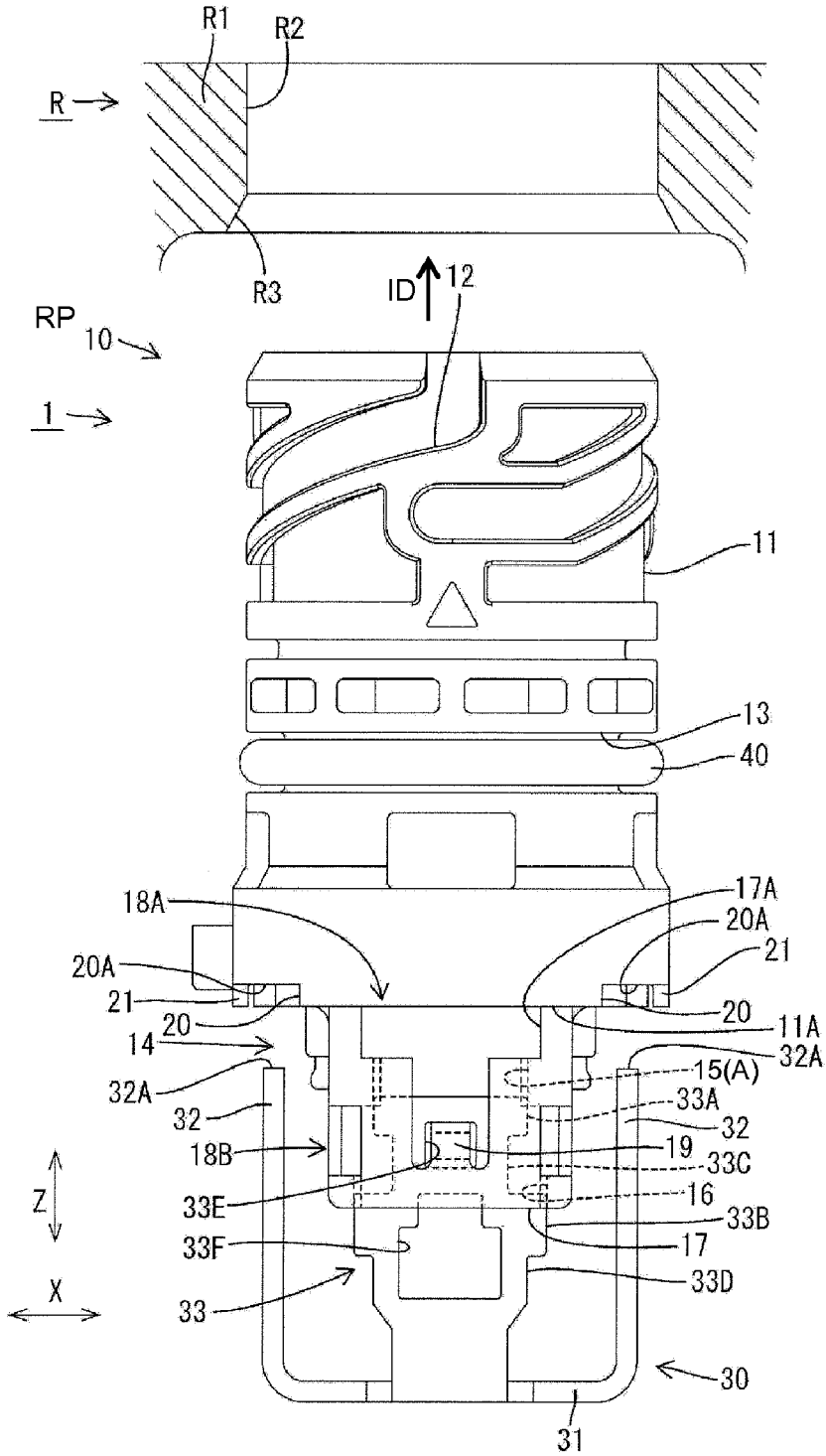
FIG. 1 is a front view showing a state where a connector of one embodiment is located at a restricted position.
Figure 2:
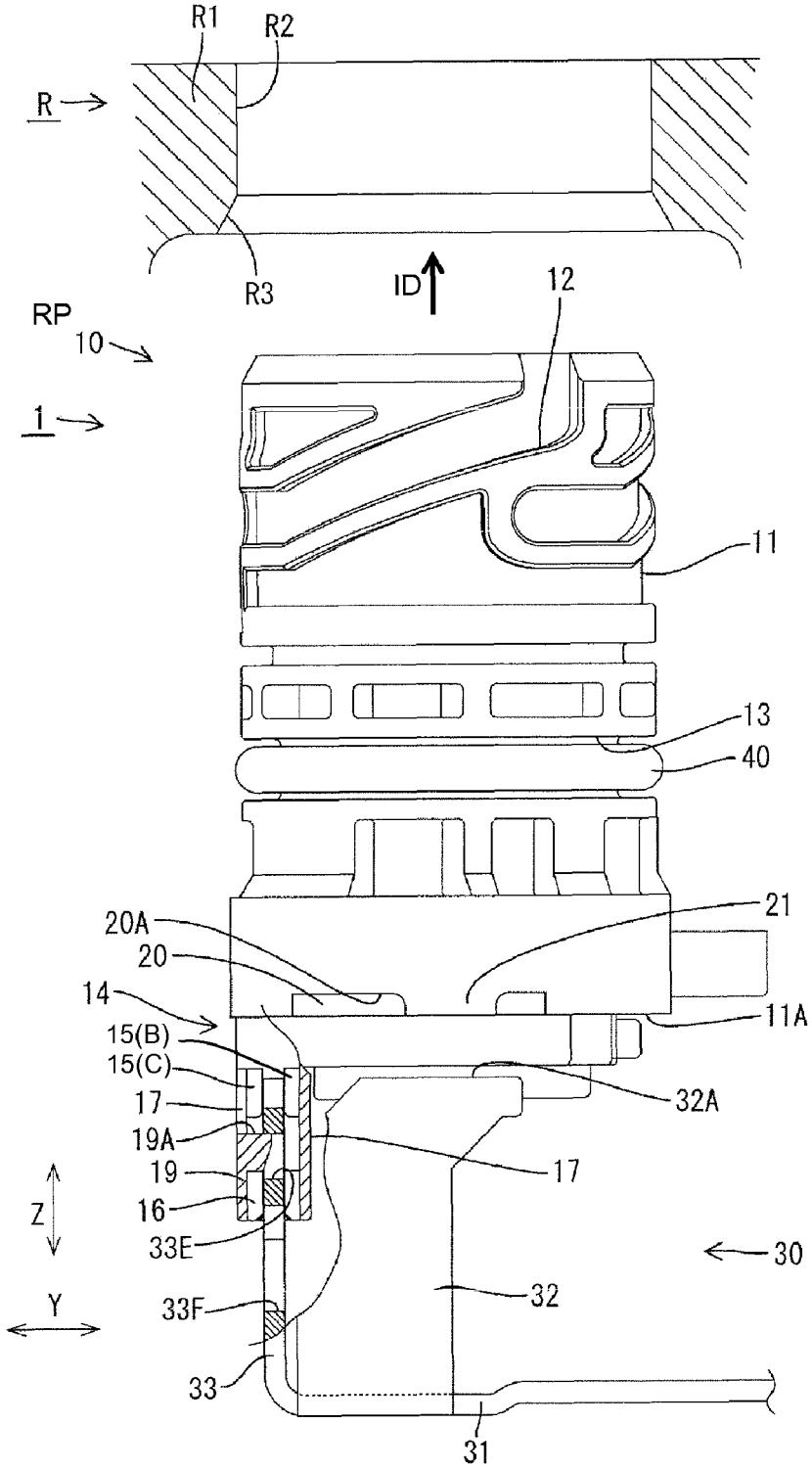
FIG. 2 is a side view partly in section showing the state where the connector is located at the restricted position.

A first embodiment of the invention is described with reference to FIGS. 1 to 11. In this embodiment, an electrical component 1 is arranged in a casing (not shown) of an automotive automatic transmission and is to be connected electrically with an external circuit via a casing R. In the following description, the arrows X in FIG. 1 denote width directions, the arrows Y in FIG. 2 denote forward and backward directions, the left side in FIG. 2 is referred to as the front end and the arrows Z in FIGS. 1 and 2 denote vertical directions.

The casing R includes a plate R1 made e.g. of synthetic resin. The plate R1 is to be provided with an external circuit connecting portion (not shown) that is to be connected with the external circuit and an electrical component connecting portion (not shown) that is to be connected with the electrical component 1. The electrical component connecting portion is provided in a mount hole R2 formed in a lower surface of the plate R1, as shown in FIG. 1. A guiding surface R3 is formed circumferentially on at least a part of the opening edge of the mount hole R2 and is inclined to gradually make an opening larger toward the lower side in the direction Z in FIG. 1.

The electrical component 1 has the connector 10 and a bracket 30 on a bottom of the connector 10. The bracket 30 supports the connector 10 movably along an inserting direction ID into the mount hole R2 between a restricting position for preventing loose movements of the connector 10 and a permitting position for permitting loose movements of the connector 10.

The bracket 30 is formed by cutting, punching or stamping a conductive metal plate and bending, folding and/or embossing the cut or punched-out metal material. The bracket 30 has a bottom portion 31 extending in substantially forward and backward directions. Two restricting pieces 32 project up from the opposite widthwise edges of the bottom portion 31 and a mounting piece 33 projects up from the front edge of the bottom portion 31. The mounting piece 33 includes a first wide portion 33A with a wide upper end and a second wide portion 33B lower than the first wide portion 33A. The second wide portion 33B is slightly wider than the first wide portion 33A and is vertically longer than the first wide portion 33A. A first narrow portion 33C is defined at a part of the mounting piece 33 between the bottom end of the first wide portion 33A and the upper end of the second wide portion 33C and is narrower than the first wide portion 33A. A second narrow portion 33D is defined at a part of the mounting piece 33 connected with the bottom end of the second wide portion 33B and is narrower than the second wide portion 33B.

A substantially rectangular first retaining hole 33E penetrates an area of the mounting piece 33 in a thickness direction and extends from the first wide portion 33A to the first narrow portion 33C. A substantially rectangular second retaining hole 33F penetrates an area of the mounting piece 33 below the upper end of the second narrow portion 33B. An upper end of the second retaining hole 33F is narrow, and the width of this narrow part is wider than width of the first retaining hole 33E. The vertical dimension of the second retaining hole 33F is longer than the vertical dimension of the first retaining hole 33E.

The connector 10 has a substantially tubular main body 11 with an open upper end, and male tabs (not shown) project up from the inner bottom end of the main body 11. At least one cam groove 12 is formed substantially spirally in an upper part of the outer circumferential surface of the main body 11. On the other hand, the electrical component connecting portion has a rotational member (not shown), and at least one cam pin (not shown) is provided on the rotational member (not shown) for insertion into the cam groove 12. The connector 10 is pulled up towards the back of the mount hole R2 by rotating the rotational member after the connector 10 is inserted into the mount hole R2 and the cam pin is inserted into the cam groove 12. The connector is connected properly with the electrical component connecting portion when the connector 10 is inserted to a proper position in the mount hole R2.

A plug mount groove 13 is formed circumferentially in the outer circumferential surface of the main body 11 below the cam groove 12. A resilient or rubber ring 40 is mounted in the plug mount groove 13. The resilient ring 40 is squeezed between the inner circumferential surface of the mount hole R2 and a circumferential surface of the plug mount groove 13 over substantially the entire circumference to prevent water or any other not desired fluid from entering the mount hole R2 from the outside.

A bracket connecting portion 14 projects down at a front end of a lower surface 11A of the main body 11 to be connected with the mounting piece 33 of the bracket 30. The bracket connecting portion 14 has first and second insertion grooves 15 and 16 for receiving the first and second wide portions 33A and 33B of the mounting piece 33. The first insertion groove 15 is above the second insertion groove 16. The bracket connecting portion 14 also includes two protection walls 17 at the opposite front and rear ends of the insertion grooves 15 and 16 to prevent the insertion grooves 15, 16 from being damaged by an external impact.

The first insertion groove 15 is formed so that the opposite lateral edges of the first wide portion 33A can be grabbed in both forward and backward directions and width directions. Specifically, the first insertion groove 15 includes two groove portions having a substantially U-shaped cross section, wherein back surfaces 15A forming part of the groove portions face each other and both groove portions are spaced apart by a specified distance in the width direction. The spacing between the back surfaces 15A is substantially equal to or slightly larger than the width of the first wide portion 33A and larger than the width of the first narrow portion 33C. Further, front surfaces 15B forming part of the groove portions are arranged to face rear surfaces 15C, and the spacing between the front and rear surfaces 15B, 15C is substantially equal to or slightly larger than the thickness of the first wide portion 33A.

Figure 9:
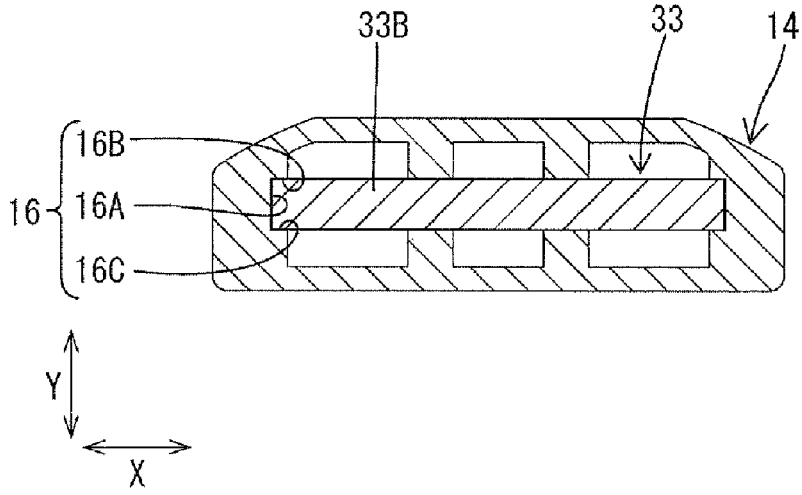
FIG. 9 is a section showing a state where movements of the connector in width directions and forward and backward directions are prevented with the connector located at the restricted position.
Figure 10:
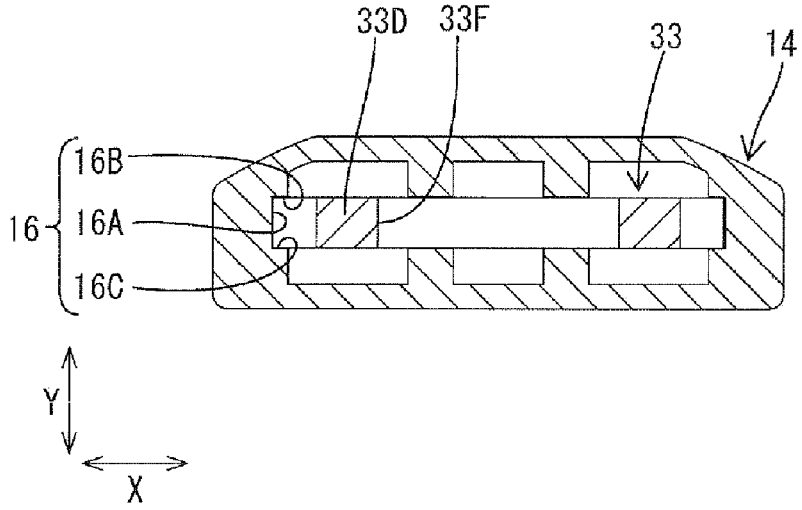
FIG. 10 is a section showing a state where the connector is so supported as to be loosely movable in width directions and forward and backward directions at the permitted position.

The second insertion groove 16 is formed so that the opposite lateral edges of the second wide portion 33B can be grabbed in both forward and backward directions and width directions. Specifically, the second insertion groove 16 includes two groove portions having a substantially U-shaped cross section. Back surfaces 16A forming part of the groove portions face each other and both groove portions are spaced apart by a specified distance in the width direction. The spacing between the back surfaces 16A is substantially equal to or slightly larger than the width of the second wide portion 33B, as shown in FIG. 9, and larger than the width of the second narrow portion 33D, as shown in FIG. 10. Further, front surfaces 16B forming part of the groove portions are arranged to face rear surfaces 16C and the spacing between the front and rear surfaces 16B, 16C is substantially equal to or slightly larger than the thickness of the second wide portion 33B.

A first accommodation space 18A is formed in the bracket connecting portion 14 between the upper end of the first insertion groove 15 and the lower surface 11A of the main body 11 and is capable of accommodating the first wide portion 33A. The first accommodation space 18A is wider and vertically longer than the first wide portion 33A. The first wide portion 33A accommodated in the first accommodation space 18A is freely movable in forward and backward directions between the both protection walls 17.

The first accommodation space 18A is exposed forward to the outside through an opening extending in the width direction in a substantially T-shaped cutout 17A made in the protection wall 17. A locking piece 19 projects up from the bottom end of a vertically extending opening of the cutout 17A and is resiliently deformable in a thickness direction of the protection wall 17.

A second accommodation space 18B is formed in the bracket connecting portion 14 between the bottom end of the first insertion groove 15 and the upper end of the second insertion groove 16 and is capable of at least partly accommodating the second wider portion 33B. The second accommodation space 18B is wider and slightly vertically longer than the second wide portion 33B. The second wide portion 33B accommodated in the second accommodation space 18B is freely movable in forward and backward directions between both protection walls 17.

As described above, the connector 10 is vertically movable relative to the bracket 30 between a restricted position RP and a permitted position PP, and is at the restricted position RP to have loose movements substantially prevented until immediately before being mounted into the mount hole R2 while being located at the permitted position PP to have loose movements thereof permitted in the course of being mounted into the mount hole R2.

When the connector 10 is at the restricted position RP, the upper end of the first wide portion 33A enters the bottom end of the first insertion groove 15, the upper end of the second wide portion 33B enters the bottom end of the second insertion groove 16 and the locking piece 19 is fit into the first retaining hole 33E, as shown in FIG. 1. Thus, the connector 10 is prevented from moving in both width directions and forward and backward directions. Further, as shown in FIG. 2, an upper-end locking surface 19A of the locking piece 19 engages the upper part of the inner circumferential surface of the first retaining hole 33E to prevent an upward detachment of the connector 10 from the bracket 30.

Figure 3:
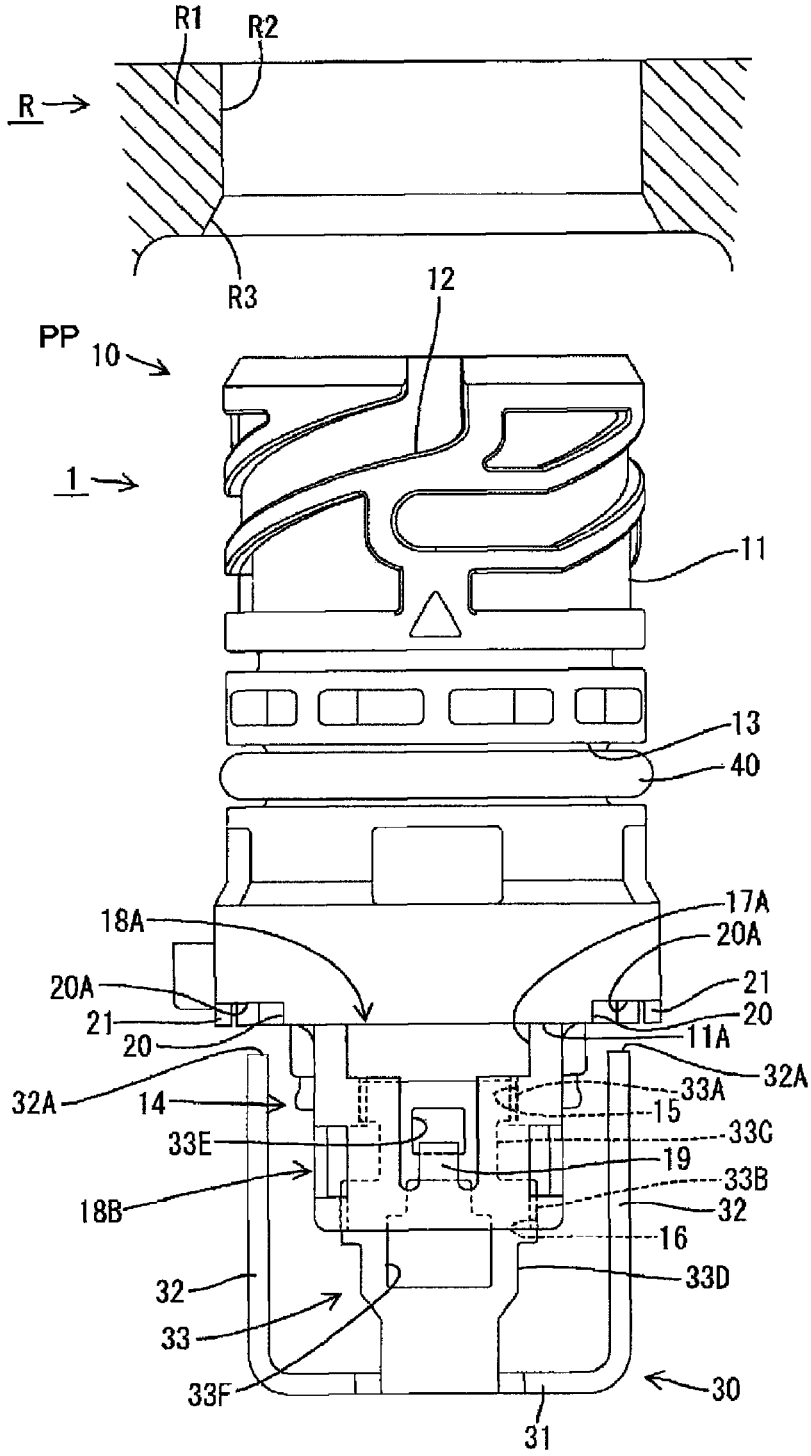
FIG. 3 is a front view showing an intermediate state of the connector moving from the restricted position to a permitted position.
Figure 4:
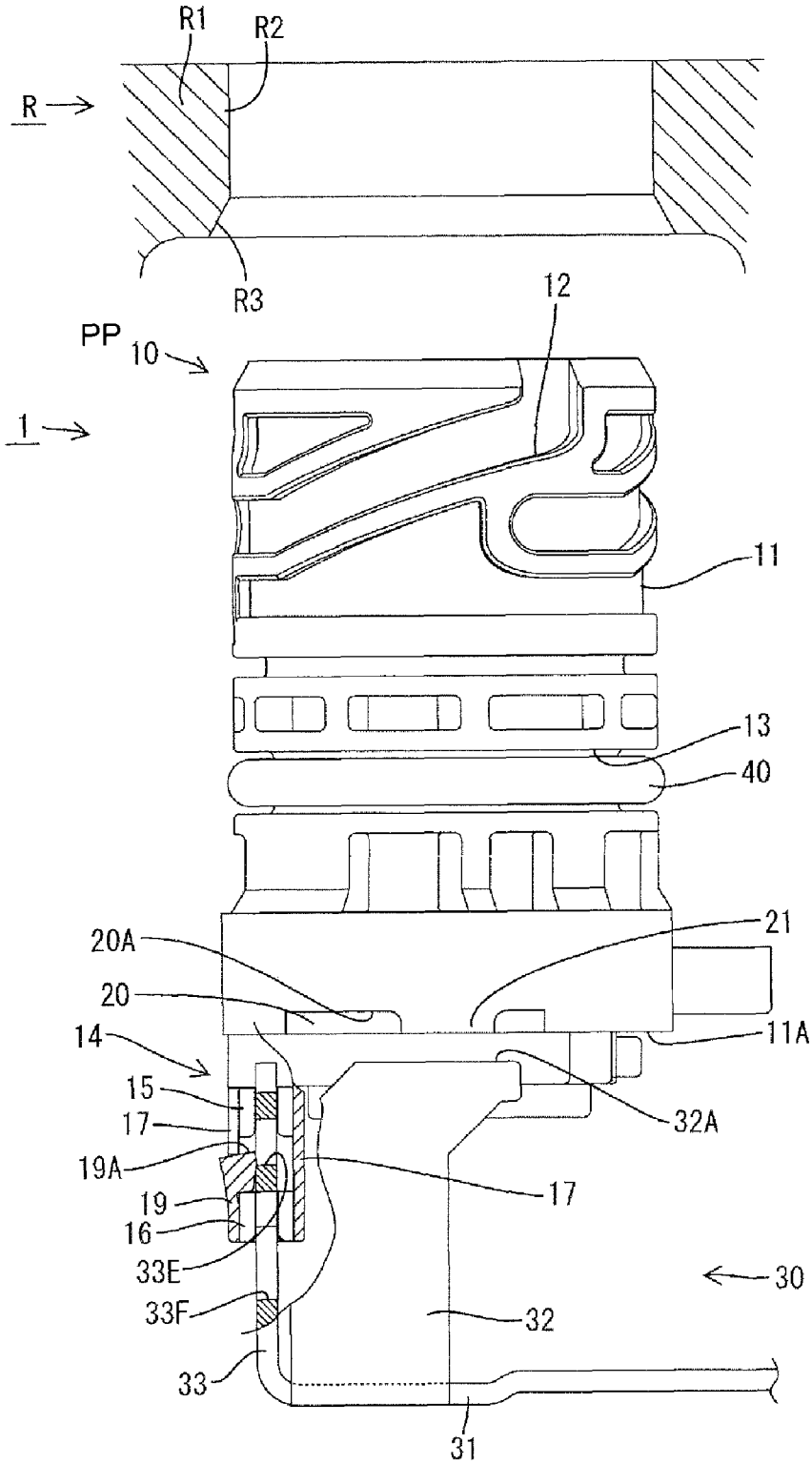
FIG. 4 is a side view partly in section showing the intermediate state of the connector moving from the restricted position to the permitted position.

The first wide portion 33A moves into the first insertion groove 15 and the second wide portion 33B moves into the second insertion groove 16 during a movement of the connector 10 from the restricted position RP to the permitted position PP, as shown in FIG. 3. Thus, the connector 10 is prevented from moving in both width directions and in forward and backward directions. At this time, the locking piece 19 is deformed resiliently, as shown in FIG. 4, and the upper-end locking surface 19A moves onto a part of the mounting piece 33 between the first and second retaining holes 33E and 33F. The locking piece 19 restores when the connector 10 reaches the permitted position PP to fit the upper-end locking surface 19A into the second retaining hole 33F, as shown in FIG. 6.

Figure 5:
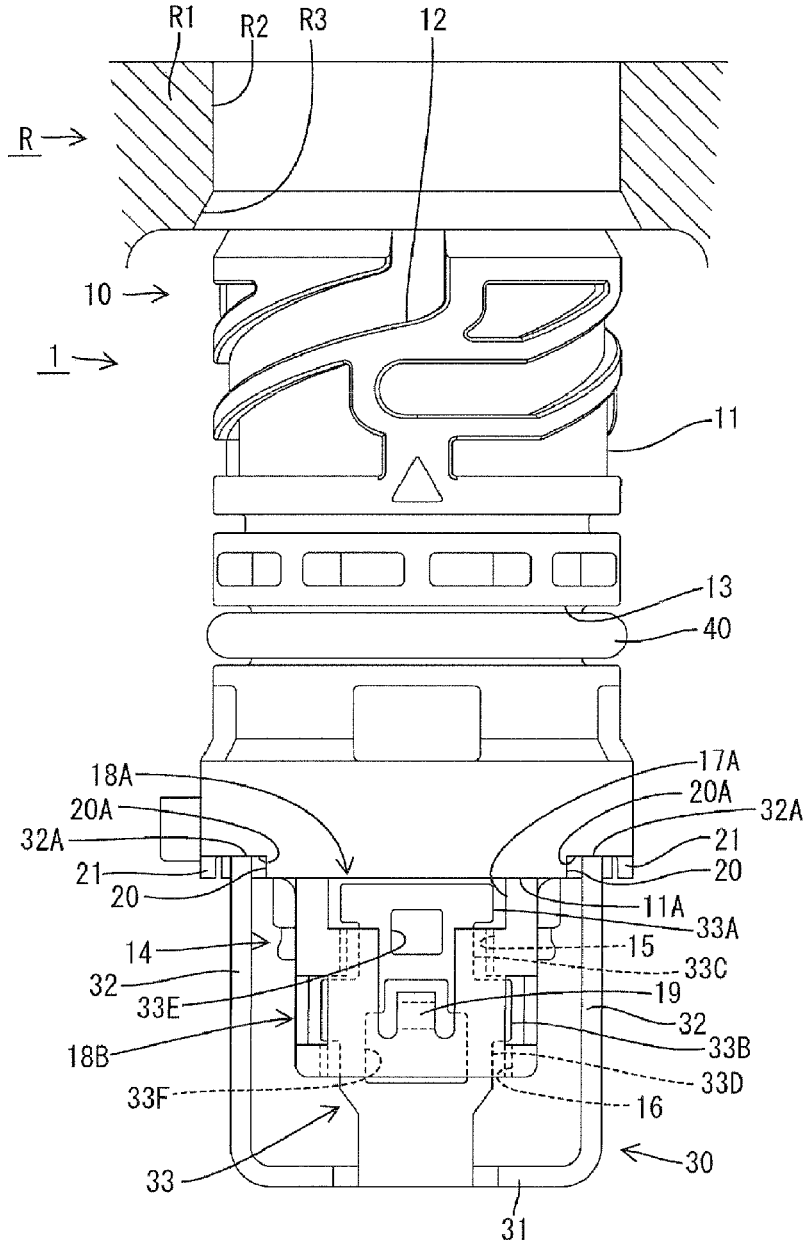
FIG. 5 is a front view showing a state where the connector is located at the permitted position.
Figure 7:
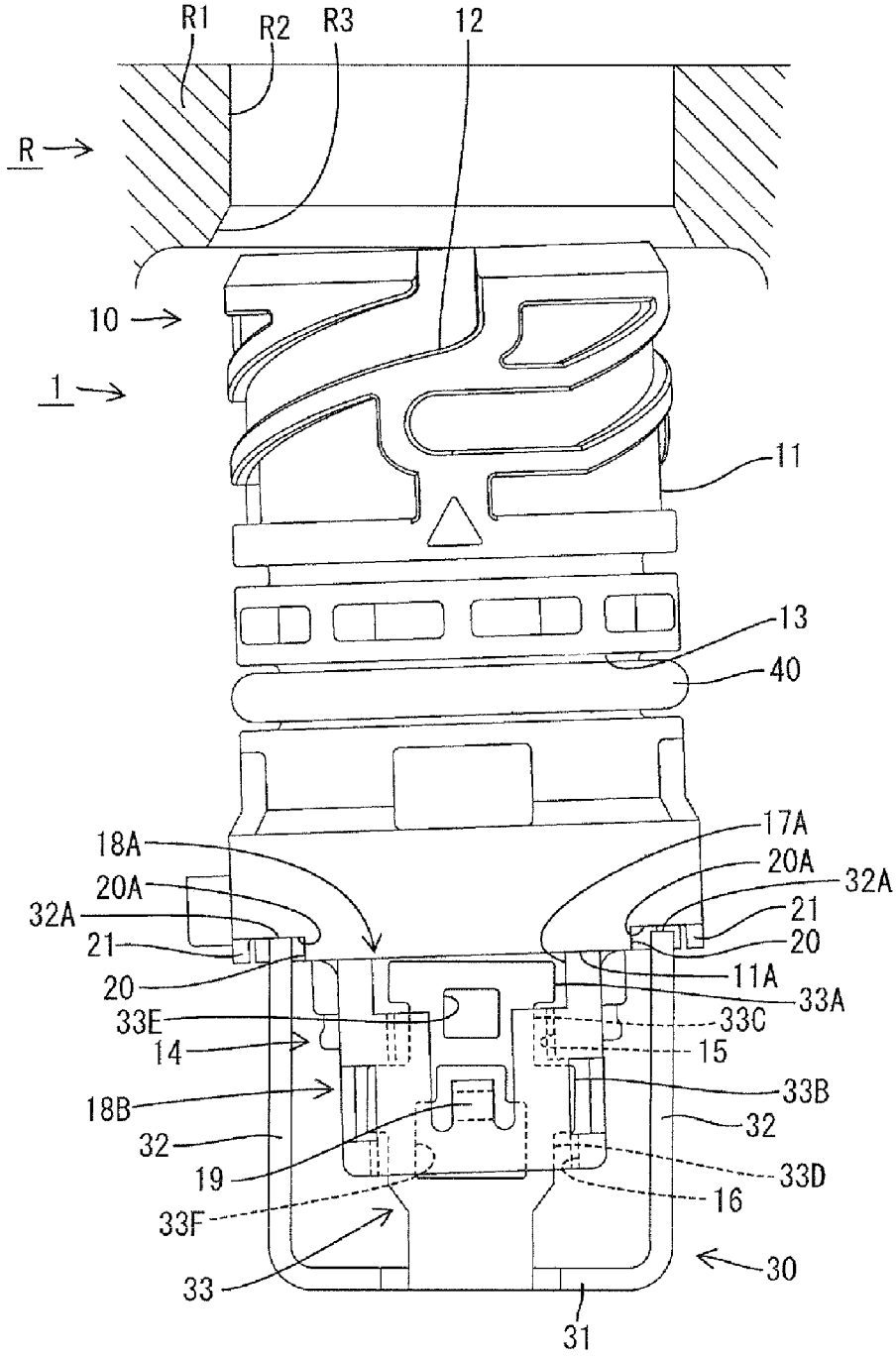
FIG. 7 is a front view showing a state where the connector is inclined with respect to width and vertical directions at the permitted position.
Figure 8:
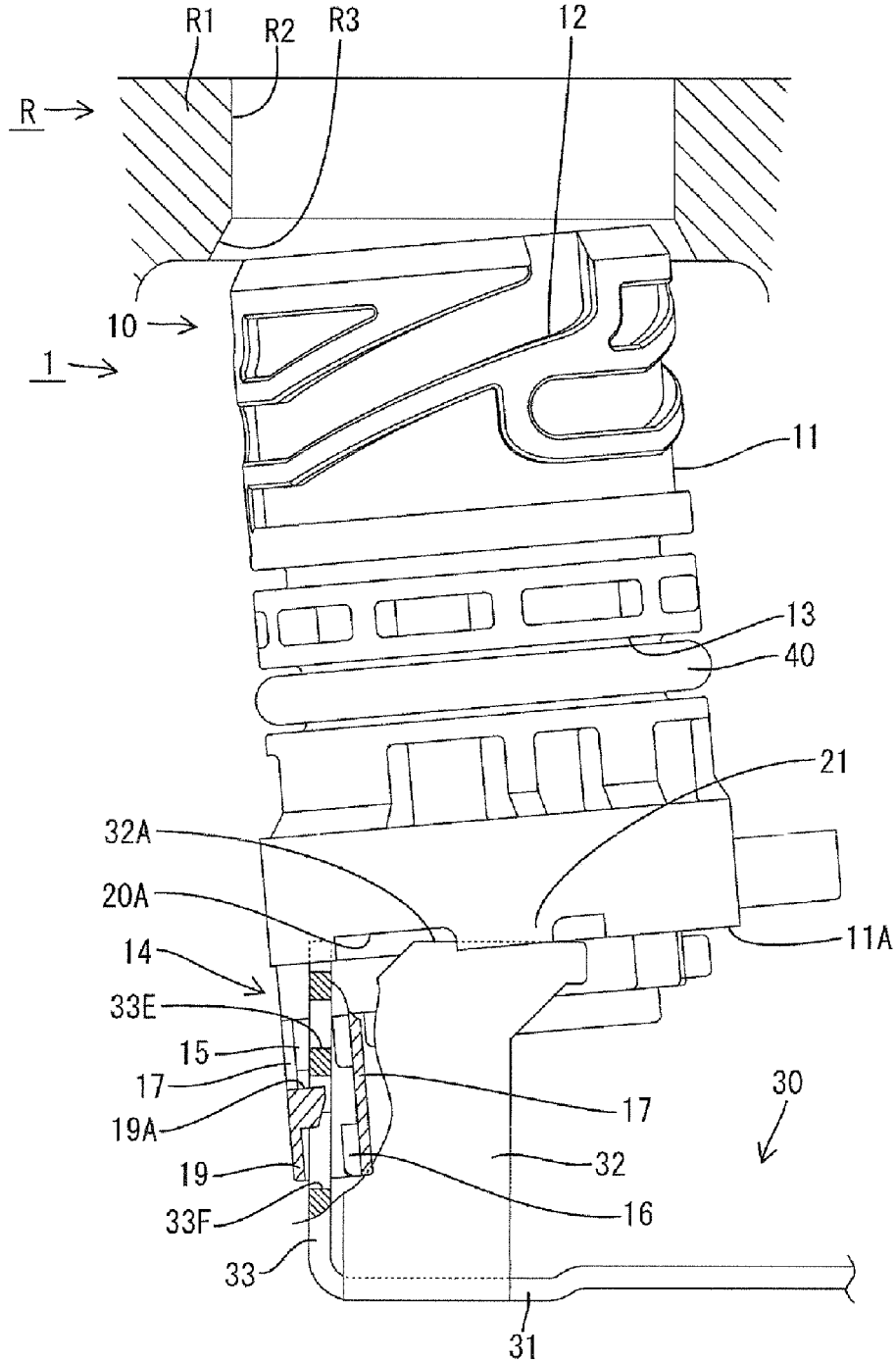
FIG. 8 is a side view partly in section showing the state where the connector is inclined with respect to width and vertical directions at the permitted position.
Figure 11:
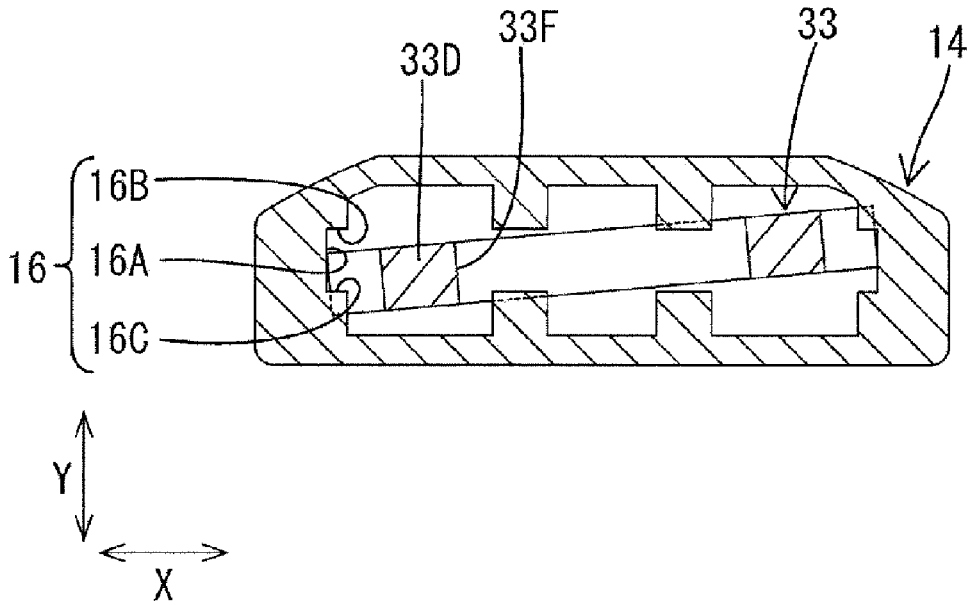
FIG. 11 is a section showing a state where the connector is inclined with respect to width directions and forward and backward directions at the permitted position.

When the connector 10 is at the permitted position PP, the first wide portion 33A is in the first accommodation space 18A, the first narrow portion 33C is between both groove portions of the first insertion groove 15, the second wide portion 33B is in the second accommodation space 18B and the second narrow portion 33D is between both grooves of the second insertion groove 16, as shown in FIG. 5. Thus, the connector 10 can move in both width directions and in forward and backward directions as shown in FIG. 7, 8 or 11.

Figure 6:
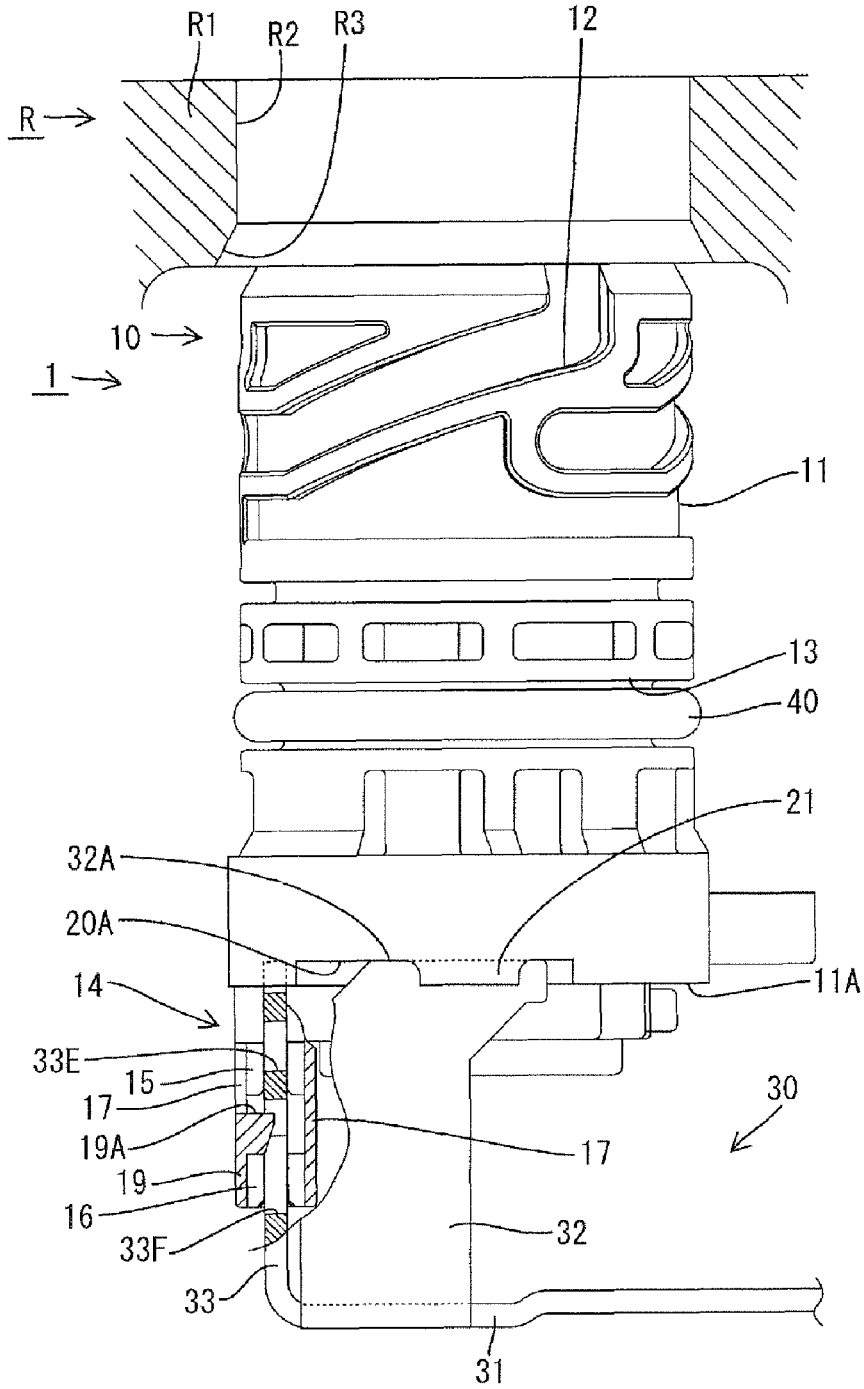
FIG. 6 is a side view partly in section showing the state where the connector is located at the permitted position.

The upper surfaces 32A of the restricting pieces 32 of the bracket 30 contact upper surfaces 20A of recesses 20 at front and rear sides of the lower surface 11A of the main body 11 when the connector 10 is at the bottommost position, as shown in FIG. 6. A clearance is defined between the upper-end locking surface 19A of the locking piece 19 and the upper side of the inner circumferential surface of the second retaining hole 33F when the connector 10 is at this bottommost position. Thus, the connector 10 is permitted to move up by as much as this clearance. Detachment preventing portions 21 hang down from the outer lateral edges of the upper surfaces 20A of the recesses 20 for preventing the upper surfaces 32A of the restricting pieces 32 from coming out of the recesses 20.

As described above, the connector 10 is prevented from moving in the width directions, forward and backward directions and vertical directions when the connector 10 is at the restricted position RP or moving from the restricted position RP to the permitted position PP, as shown in FIGS. 1 to 4. On the other hand, the connector 10 can move loosely on the bracket 30 when the connector 10 is at the permitted position PP, as shown in FIGS. 5 and 6. Thus, the connector 10 can move in width directions and vertical directions, as shown in FIG. 7, and can move in forward and backward directions and vertical directions, as shown in FIG. 8. Further, the detachment preventing portions 21 prevent detachment of the upper surfaces 32A of the restricting pieces 32 from the recesses 20 even if the connector 10 is inclined relative to the bracket 30, as shown in FIG. 7.

The electrical component 1 is brought close to the casing R with the connector 10 located at the restricted position RP. The upper end of the first wide portion 33A is inserted in the first insertion groove 15 and the upper end of the second wide portion 33B is inserted in the second insertion groove 16 to prevent the connector 10 at the restricted position RP from moving in width directions, forward and backward directions and vertical directions since. Therefore, the connector 10 can be aligned easily with the mount hole R2.

FIG. 1 shows a state immediately before the connector 10 is mounted into the mount hole R2, and the bracket 30 is brought relatively closer to the connector 10 as the bracket 30 is pushed. The disposition of the first wide portion 33A in the first insertion groove 15 and the disposition of the second wide portion 33B in the second insertion groove 16, as shown in FIGS. 3 and 4, prevents the connector 10 from moving in width directions, forward and backward directions and vertical directions as the connector 10 is moving from the restricted position RP to the permitted position PP.

The resilient ring 40 contacts areas of the casing R adjacent the mount hole R2 and urges the bracket 30 to the permitted position PP. When the connector 10 reaches the permitted position PP, the first wide portion 33A is in the first accommodation space 18A at an angle, the first narrow portion 33C is arranged between both groove portions of the first insertion groove 15 at an angle, the second wide portion 33B is in the second accommodation space 18B at an angle and the second narrower portion 33D is arranged between both groove portions of the second insertion groove 16 at an angle, as shown in FIGS. 5 and 6. Thus, the connector 10 at the permitted position PP can move loosely in width directions, forward and backward directions and vertical directions, as shown in FIGS. 7, 8 and 11.

The connector 10 that has been brought relatively closer to the mounting piece 33 then is inserted into the mount hole R2 for assembling the electrical component 1 to the casing R. An assembling direction of the electrical component 1 may be inclined with respect to a proper assembling direction. However, the connector 10 is supported for loose movement relative to the bracket 30. Thus, the connector 10 will not be pressed against the inner circumferential surface of the mount hole R2, and a smooth insertion of the connector 10 into the mount hole R2 is ensured since an assembling error of the electrical component 1 into the casing R is absorbed.

As described above, loose movements of the connector 10 are prevented until immediately before the connector 10 is mounted into the mount hole R2 of the casing R. Thus, the connector 10 of the electrical component 1 can be aligned more easily with the mount hole R2. Further, there is no likelihood that the axial center position of the connector 10 is displaced from the axial center of the mount hole R2 since loose movements of the connector 10 are permitted in the course of mounting the connector 10 into the mount hole R2. Therefore, the connector 10 can be mounted easily into the mount hole R2.

A mounting direction ID of the connector 10 into the mount hole R2 substantially coincides with an inserting direction of the mounting piece 33 into the connector 10. Thus, the connector 10 can be mounted into the mount hole R2 after inserting the mounting piece 33 into the insertion grooves 15, 16.

Contact of the opposite widthwise sides of the mounting piece 33 with the back surfaces 15A, 16A of the insertion grooves 15, 16 prevent movements of the connector 10 in width directions when the connector 10 is at the restricted position RP. Similarly, contact of the front and rear sides of the mounting piece 33 with the front and rear surfaces 15B, 15C, 16B and 16C of the insertion grooves 15, 16 prevent movements of the connector 10 in forward and backward directions when the connector 10 is at the restricted position RP.

The engagement of the upper-end locking surface 19A of the locking piece 19 with the upper part of the inner circumferential surface of the first retaining hole 33E prevents upward detachment of the connector 10 when the connector 10 is at the restricted position RP. On the other hand, the engagement of the locking piece 19 with the upper part of the inner circumferential surface of the second retaining hole 33F prevents upward detachment of the connector 10, but permits loose movements of the connector 10 when the connector 10 is at the permitted position PP.

The invention is not limited to the above described and illustrated embodiment. For example, the following modifications are also embraced by the technical scope of the present invention as claimed.

The connector 10 is at the restricted position RP up to a position at a specified distance to the mount hole R1, as shown in FIG. 1, in the above embodiment. However, the connector 10 may be at the restricted position RP up to the position in FIG. 5 immediately before being inserted into the mount hole R2.

The mounting piece 33 is inserted vertically into the insertion grooves 15, 16 in the above embodiment. However, the mounting piece 33 may be inserted into the insertion grooves in any other way or by any other operation, e.g. by insertion in the width direction or forward or backward direction or by rotating the connector 10 about an axial line vertically passing the center of the main body 1 according to the invention.

The connector 10 at the restricted position RP is prevented from moving in any of the width directions, forward and backward directions and vertical directions in the above embodiment. However, the connector 10 may be prevented from moving in one of the above directions according to the present invention.

A second embodiment of the invention is described with reference to FIGS. 12 to 19. In this embodiment, an electrical component 1 arranged in a casing (not shown) of an automotive automatic transmission is connected electrically with an external circuit via a casing R. In the following description, reference is made to directions of arrows in FIG. 12 concerning width directions, to lateral directions in FIG. 13 concerning forward and backward directions with a left side in FIG. 13 referred to as the front, and to vertical directions in FIGS. 12 and 13 concerning vertical directions.

Figure 12:
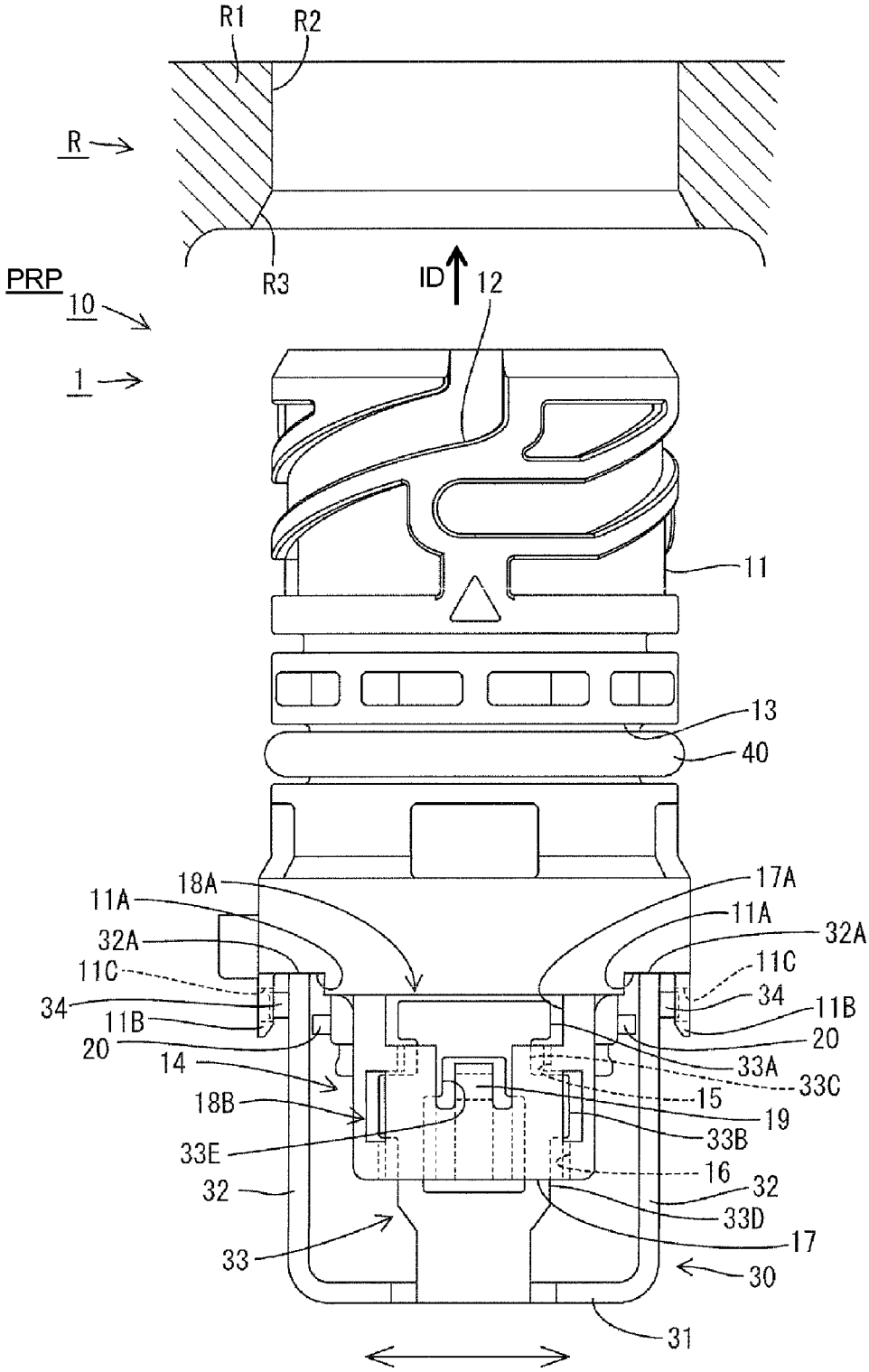
FIG. 12 is a front view showing a state where a connector is located at a proper position in one further embodiment.
Figure 13:
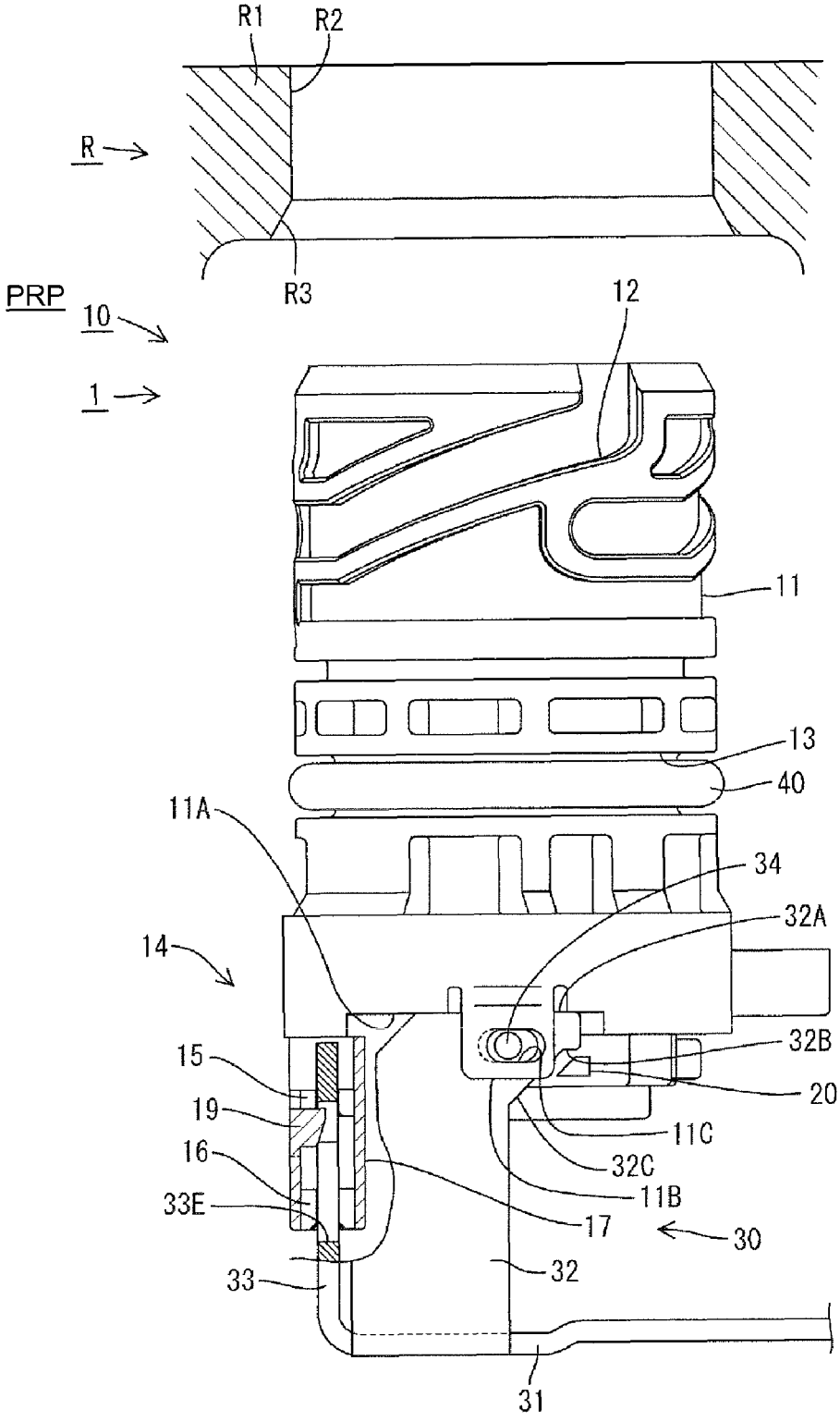
FIG. 13 is a side view partly in section showing the state where the connector is located at the proper position.

The casing R includes a plate R1 made e.g. of synthetic resin. The plate R1 has an external circuit connecting portion (not shown) to be connected with the external circuit and an electrical component connecting portion (not shown) to be connected with the electrical component 1. The electrical component connecting portion is provided in a mount hole R2 formed in the plate R1, as shown in FIG. 12. A guiding surface R3 is formed circumferentially at the opening edge of the mount hole R2 and is inclined to make the opening gradually larger towards the lower side in the direction Z in FIG. 12.

The electrical component 1 includes the connector 10 and a bracket 30 that is to be mounted on a bottom end portion of the connector 10. The connector 10 is supported by the bracket 30 for loose movement and is mounted into the mount hole R2 of the casing R by assembling the electrical component 1 into the casing R in this state.

The bracket 30 is formed by stamping, cutting or punching a conductive or metal plate out and bending, folding and/or embossing the cut- or punched-out metal material. The bracket 30 includes a flat bottom plate 31 extending in forward and backward directions. A mounting piece 33 projects up from the front edge of the bottom plate 31, and two restricting pieces 32 project up from the opposite widthwise edges of the bottom plate 31 and face each other at the opposite sides of the mounting piece 33.

The mounting piece 33 includes a first wide portion 33A with a wide upper end and a second wide portion 33B lower than the first wide portion 33A. The second wide portion 33B is slightly wider and vertically longer than the first wide portion 33A. A first narrower portion 33C is formed on a part of the mounting piece 33 between the bottom end of the first wide portion 33A and the upper end of the second wide portion 33C and is narrower than the first wide portion 33A. Additionally, a second narrower portion 33D is connected with the bottom end of the second wide portion 33B and is narrower than the second wide portion 33B.

A retaining hole 33E penetrates the mounting piece 33 in a thickness direction along an area of the mounting piece 33 from the first wide portion 33A to the second narrow portion 33D. An upper end of the first retaining hole 33E is formed to be narrower.

A leading-end edge of each restricting piece 32 projects slightly back and has an upper horizontal surface 32A at the upper end thereof. A vertical surface extends down from the rear end edge of the upper horizontal surface 32A. A lower horizontal surface 32B extends forward from the bottom end edge of the vertical surface and is substantially parallel to the horizontal surface 32A. An inclined surface 32C extends obliquely down towards the front from the front end edge of the lower horizontal surface 32B. The upper horizontal surface 32A, the vertical surface, the lower horizontal surface 32B and the inclined surface 32C define a leading-end outer peripheral edge of a restricting piece.

A substantially cylindrical projection 34 projects out in a width direction from the outer side surface of the leading-end edge of each restricting piece 32. The outer circumferential surface of the projection 34, the upper horizontal surface 32A and the lower horizontal surface 32B define an inclination restricting portion.

The connector 10 includes a tubular main body 11 having an open upper end, and male tabs (not shown) project up from the inner bottom end of the main body 11. At least one cam groove 12 is formed spirally in an upper part of the outer circumferential surface of the main body 11. On the other hand, the electrical component connecting portion includes a rotational member (not shown). At least one cam pin (not shown) provided on the rotational member (not shown) is insertable into the cam groove 12. Thus, the connector 10 is pulled up towards the mount hole R2 by rotating the rotational member after the connector 10 is inserted partly into the mount hole R2 and the cam pin is inserted partly into the cam groove 12. The connector 10 is connected properly with the electrical component connecting portion when the connector 10 is inserted up to a proper position in the mount hole R2.

A plug mount groove 13 is formed circumferentially below the cam groove 12 in the outer circumferential surface of the main body 11 and a resilient rubber ring 40 is mounted in the plug mount groove 13. The rubber ring 40 is squeezed between the inner circumferential surface of the mount hole R2 and a circumferential surface of the plug mount groove 13 over substantially the entire circumference when the main body 11 is inserted into the mount hole R2 to prevent undesired fluid from entering the mount hole R2 from the outside.

A bracket connecting portion 14 projects down at the front edge of a bottom end of the main body 11 and is to be connected with the mounting piece 33 of the bracket 30. Flat contact surfaces 11A are formed at the opposite widthwise sides of the bottom end of the main body 11. The contact surfaces 11A contact the upper horizontal surfaces 32A of the restricting pieces 32 when the connector 10 is mounted for loose movement relative to the bracket 30.

The bracket connecting portion 14 includes a first insertion groove 15 for receiving the first wide portion 33A of the mounting piece 33 and a second insertion groove 16 for receiving the second wide portion 33B of the mounting piece 33. The first insertion groove 15 is above the second insertion groove 16. The bracket connecting portion 14 also includes two protection walls 17 at the opposite front and rear ends of both insertion grooves 15 and 16 to prevent the insertion grooves 15, 16 from being damaged by an external impact.

A first accommodation space 18A is formed in the bracket connecting portion 14 above the first insertion groove 15 for accommodating the first wide portion 33A. A dimension of the first accommodation space 18A in forward and backward directions is larger than the first wide portion 33A and the width of the first accommodation space 18A is larger than the width of the first wide portion 33A. Thus, the first wide portion 33A is freely movable in forward and backward directions and width directions between the protection walls 17 in the first accommodation space 18A.

The protection wall 17 has a cutout 17A with a T-shaped opening extending in the width direction and the first accommodation space 18A is exposed forward to the outside through this opening. A locking piece projects up from the bottom end of a vertically extending opening of the cutout 17A and is resiliently deformable forward and backward in the thickness directions of the protection wall 17.

A second accommodation space 18B is formed in the bracket connecting portion 14 between the bottom end of the first insertion groove 15 and the upper end of the second insertion groove 16 and is capable of accommodating the second wide portion 33B. The depth of the second accommodation space 18B in forward and backward directions exceeds the depth of the second wide portion 33B and the width of the second accommodation space 18B is slightly larger than the width of the second wide portion 33B. Thus, the second wide portion 33B is freely movable in forward and backward directions and width directions between the protection walls 17 in the second accommodation space 18B.

A first narrow portion 33C is formed in the mounting piece 33 between the first and second wide portions 33A, 33B and is narrower than both wide portions 33A, 33B. The first narrower portion 33C is arranged inwardly of the groove portions of the first insertion groove 15 in width directions, and is freely movable in forward and backward directions and width directions between the protection walls 17. A second narrower portion 33D is formed in the mounting piece 33 below and adjacent to the second wide portion 33B and is narrower than the second wide portion 33B. The second narrow portion 33D is inwardly of both groove portions of the second insertion groove 16 in width directions, and is freely movable in forward and backward directions and width directions between the both protection walls 17.

The first wide portion 33A is in the first accommodation space 18A, the first narrow portion 33C is between the groove portions of the first insertion groove 15, the second wide portion 33B is in the second accommodation space 18B and the second narrow portion 33D is between the grooves of the second insertion groove 16, when the bracket connecting portion 14 of the connector 10 is mounted on the mounting piece 33 of the bracket 30, as shown in FIG. 12. Thus, the connector 10 is permitted to move in width directions between a proper position PRP shown in FIG. 12 and an end position ENP shown in FIG. 16. The connector 10 also is permitted to move in forward and backward directions between a proper position PRP shown in FIG. 13, a rear end position REP shown in FIG. 18 and a front end position shown FEP in FIG. 19.

The Z-axis is substantially parallel to the axial center of the connector 10 inserted into the mount hole R2. As described herein, the connector 10 is permitted to move in width directions and forward and backward directions along a plane intersecting the Z-axis while the inclination of the axial center of the connector 10 with respect to the Z-axis is prevented.

Figure 18:
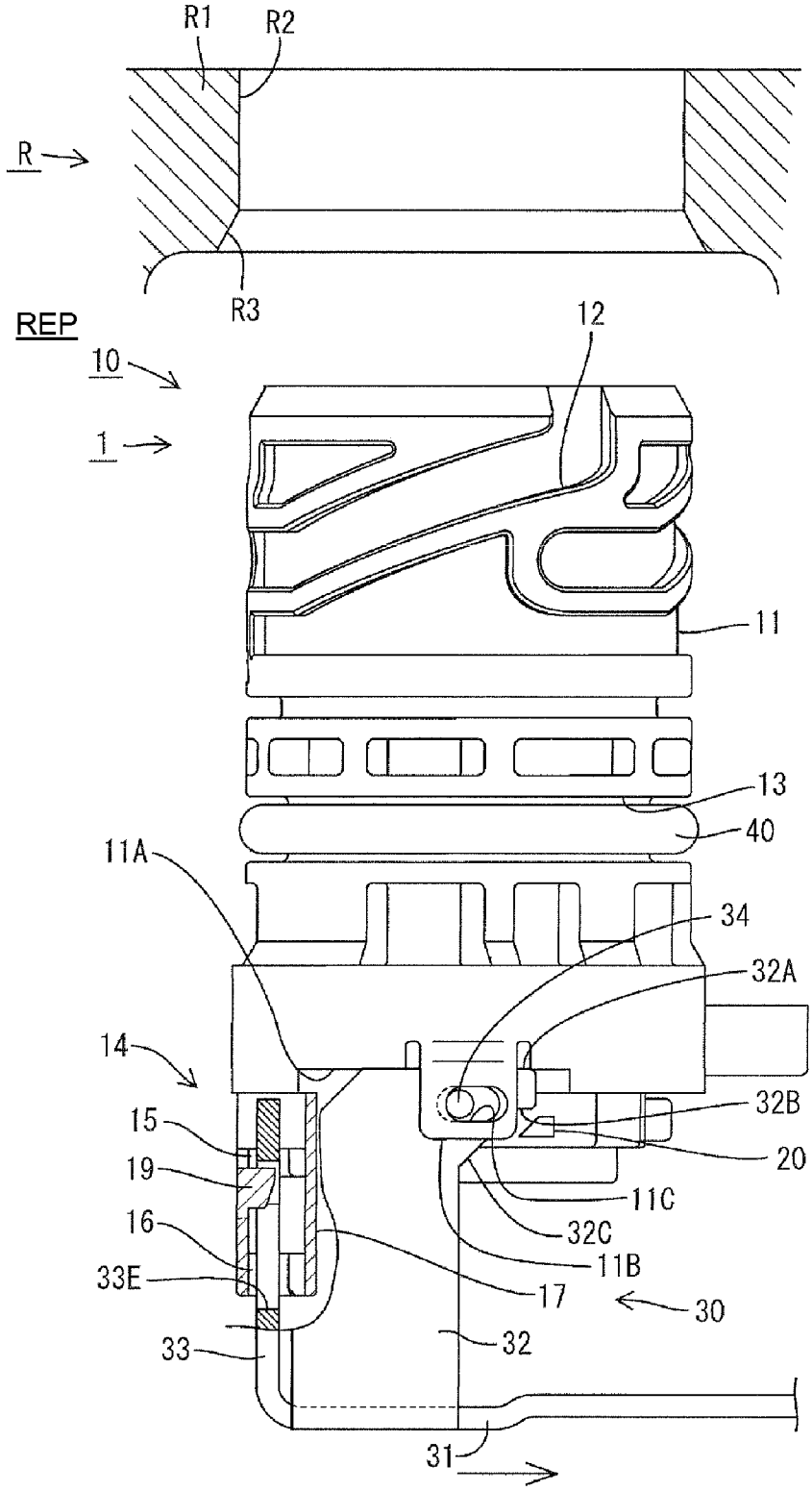
FIG. 18 is a side view partly in section showing a state where the connector is located at a rear end position.
Figure 19:
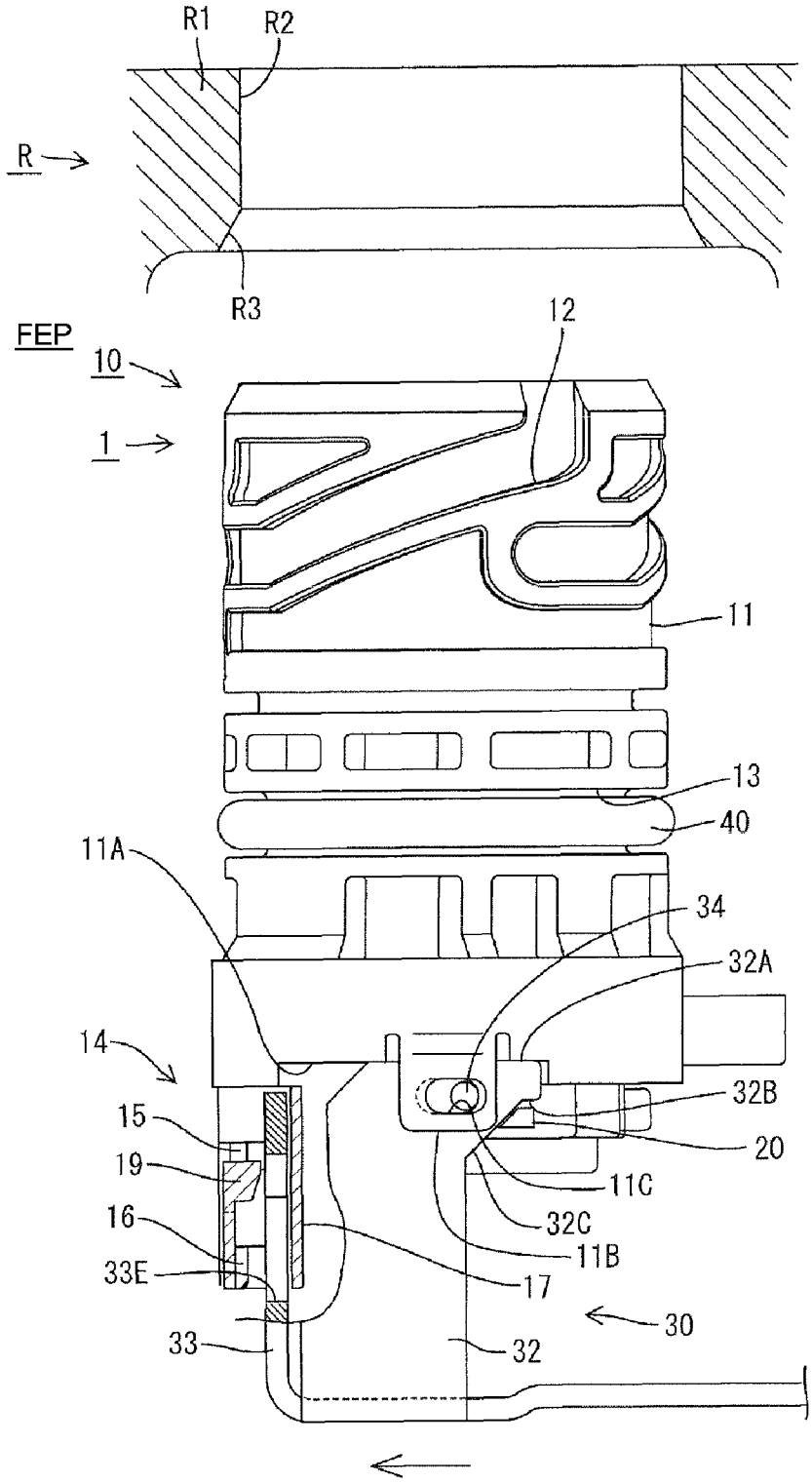
FIG. 19 is a side view partly in section showing a state where the connector is located at a front end position.

Two resilient pieces 11B project down at the outer edges of both contact surfaces 11A of the main body 11. The resilient pieces 11B are arranged to face in width directions and are resiliently deformable out in width directions. Restricting holes 11C penetrate the resilient pieces 11B and are long in forward and backward directions. The leading ends of the projections 34 are fit in the corresponding restricting holes 11C with the connector 10 located at the proper position PRP, as shown in FIG. 12. The restricting holes 11C are longer in forward and backward directions than the diameter of the projections 34. Thus, the connector 10 can move to the rear end position REP as shown in FIG. 18 and to the front end position FEP as shown in FIG. 19.

If the connector 10 tries to incline to the left with the leading ends of both projections 34 fit in the corresponding restricting holes 11C, the lower part of the inner circumferential surface of the right restricting hole 11C contacts the lower part of the outer circumferential surface of the right projection 34 and the upper part of the inner circumferential surface of the left restricting hole 11C contacts the upper part of the outer circumferential surface of the left projection 34 or the left contact surface 11A contacts the upper horizontal surface 32A of the left restricting piece 32. In any of the contact states, the connector 10 is held substantially in contact with both restricting pieces 32 at the opposite widthwise sides. Therefore rotational moment of the connector 10 is resisted and a lateral inclination of the connector 10 is prevented.

If the connector 10 tries to incline to the right, the lower part of the inner circumferential surface of the left restricting hole 11C contacts the lower part of the outer circumferential surface of the left projection 34 and the upper part of the inner circumferential surface of the right restricting hole 11C contacts the upper part of the outer circumferential surface of the right projection 34 or the right contact surface 11A contacts the upper horizontal surface 32A of the right restricting piece 32. In any of the contact states, the connector 10 is held substantially in contact with the both restricting pieces 32 at the opposite widthwise sides. Therefore a rotational moment of the connector 10 is resisted and a rightward inclination of the connector 10 is prevented.

Figure 14:
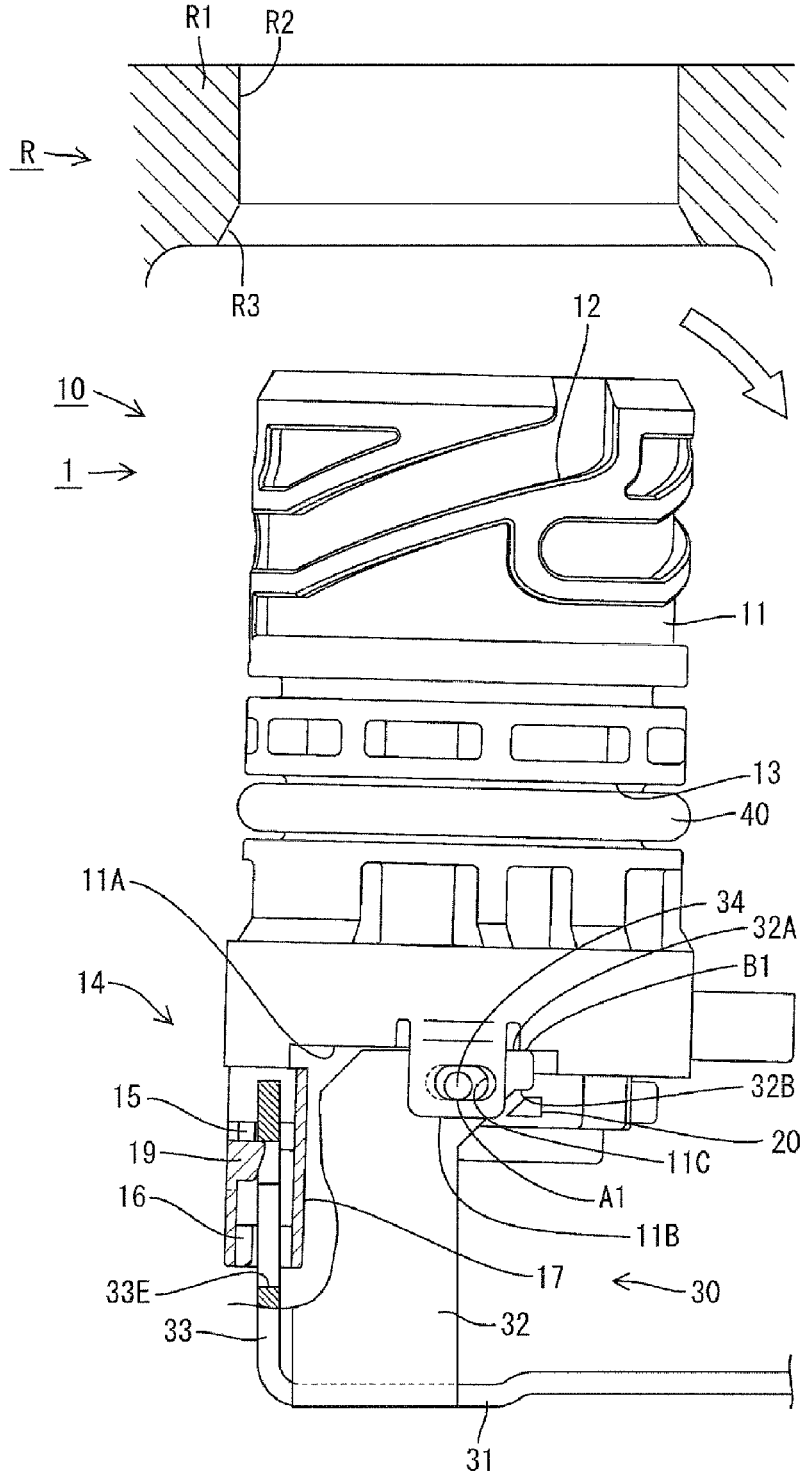
FIG. 14 is a side view partly in section showing a state where a backward inclination of the connector is prevented at the proper position.

If the connector 10 tries to incline backward at the proper position PRP, the lower parts of the inner circumferential surfaces of the restricting holes 11C contact the lower parts of the outer circumferential surfaces of the projections 34 and the contact surfaces 11A contact the rear ends of the upper horizontal surfaces 32A of the restricting pieces 32 as shown in FIG. 14. In this way, the connector 10 contacts each restricting piece 32 at two front and rear contact portions A1, B1. Therefore rotation of the connector 10 is resisted and a backward inclination of the connector 10 is prevented.

Figure 15:
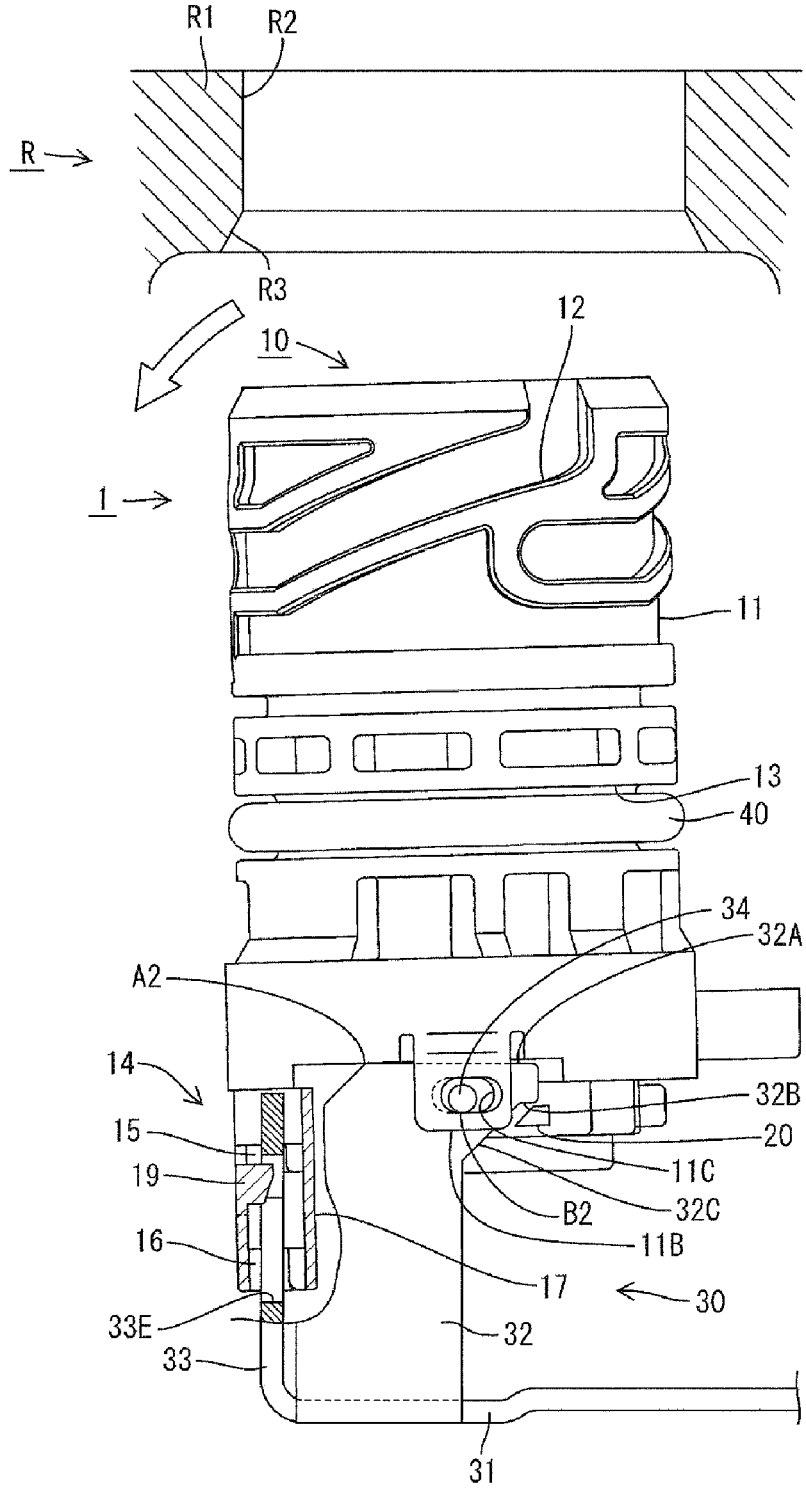
FIG. 15 is a side view partly in section showing a state where a forward inclination of the connector is prevented at the proper position.

If the connector 10 tries to incline forward at the proper position PRP, the contact surfaces 11A contact the front ends of the upper horizontal surfaces 32A of the restricting pieces 32 and the lower parts of the inner circumferential surfaces of the restricting holes 11C contact the lower parts of the outer circumferential surfaces of the projections 34, as shown in FIG. 15. In this way, the connector 10 contacts each restricting piece 32 at two front and rear contact portions A2, B2. Therefore rotation of the connector 10 is resisted and a forward inclination of the connector 10 is prevented.

As described above, the connector 10 at the proper position PRP contacts the leading-end edge portion of each restricting piece 32 at two front and rear contact portions A1, B1 or A2, B2. Further, the connector 10 at the proper position PRP contacts the leading-end edges of the restricting pieces 32 at the opposite widthwise sides by arranging the leading-end edges of the restricting pieces 32 in a width direction that intersects the forward and backward directions that connect the connect portions A1, B1 or A2, B2. Thus, forward, backward, leftward and rightward inclinations of the connector 10 at the proper position PRP are prevented. The above description relates to the movements when the connector 10 is located at the proper position PRP, but it goes without saying that forward, backward, leftward and/or rightward inclinations are prevented even if the connector 10 is moved substantially parallel to the front end position FEP or the rear end position REP, and movements at the respective positions are not described since they are similar to those at the proper position PRP.

Figure 16:
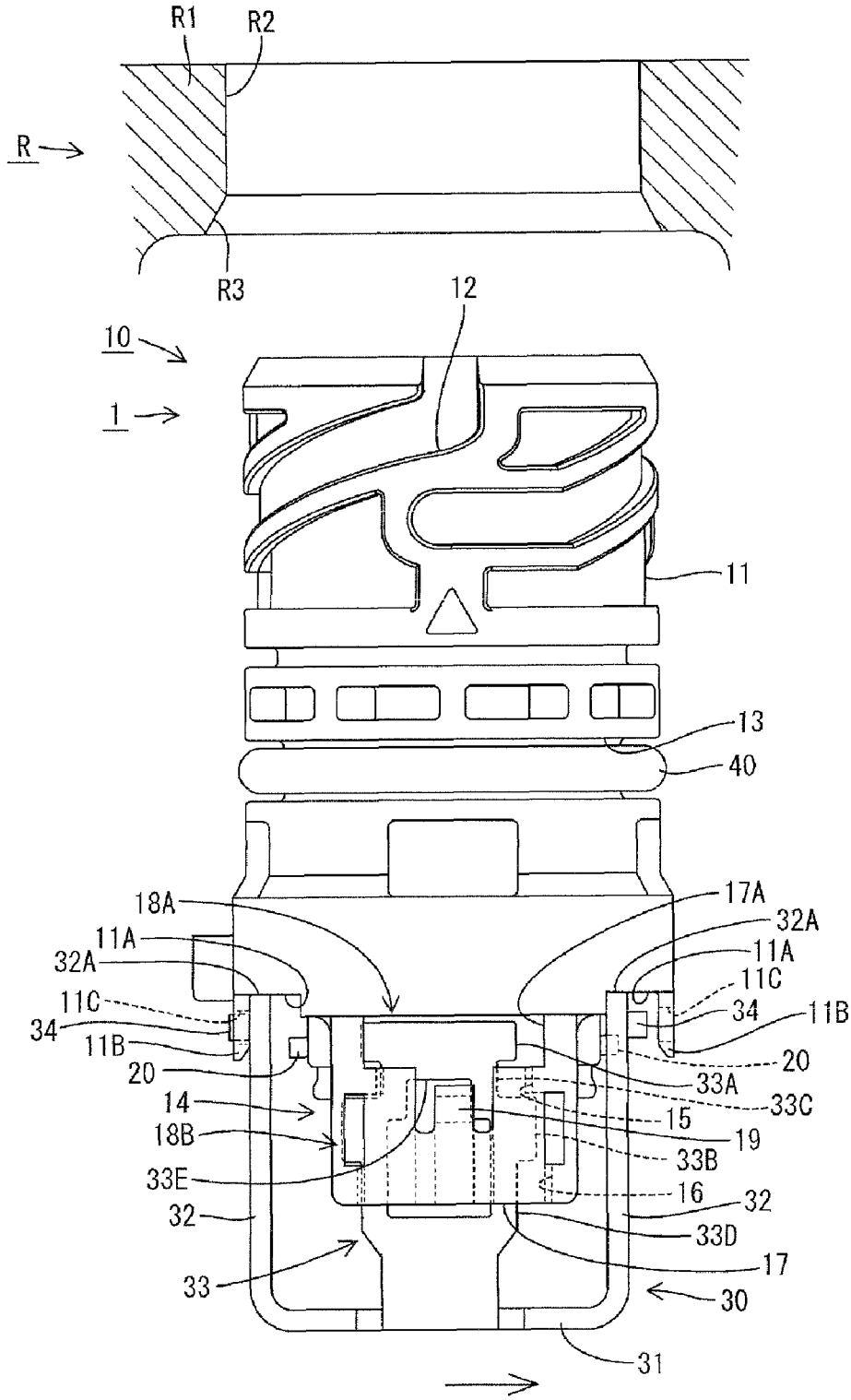
FIG. 16 is a front view showing a state where the connector is located at an end position.
Figure 17:
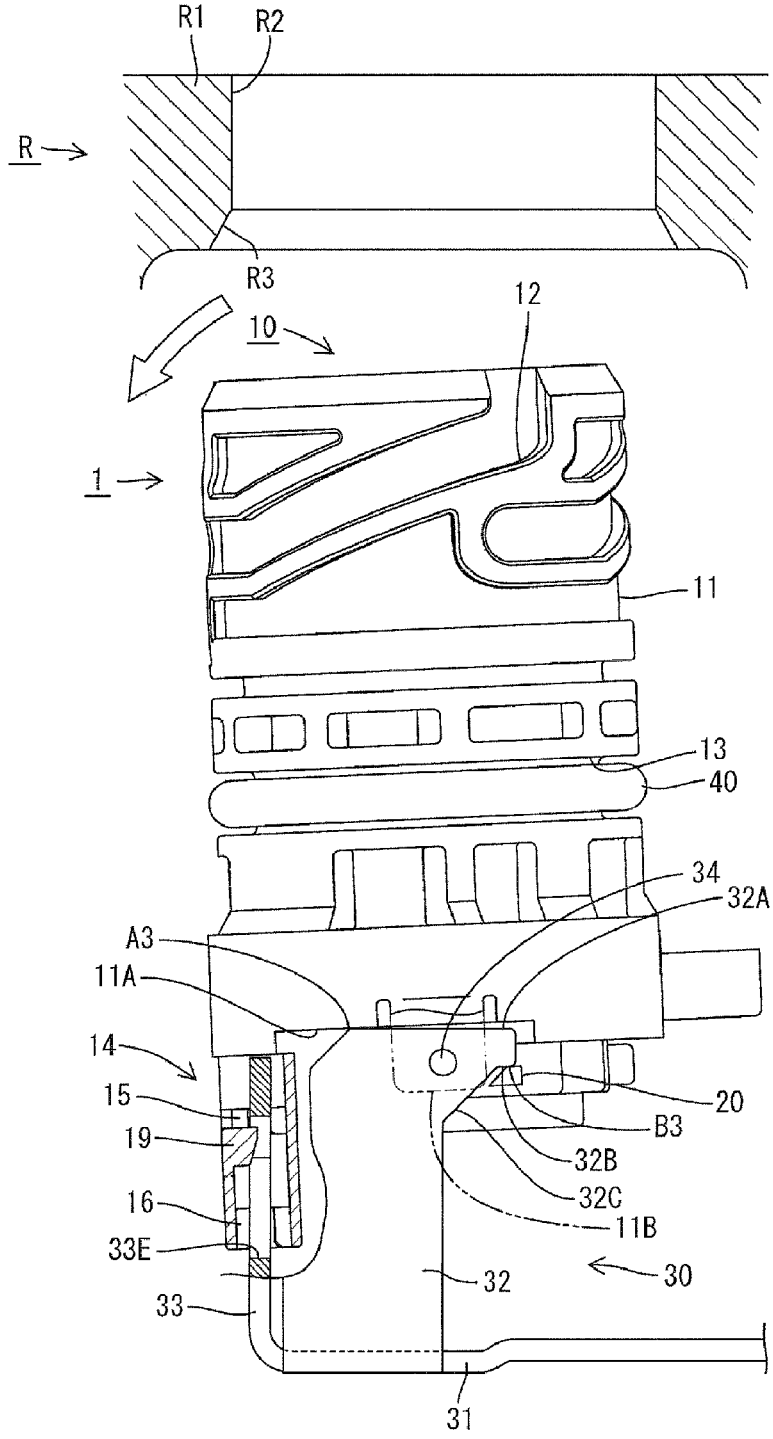
FIG. 17 is a side view partly in section showing a state where a forward inclination of the connector is prevented at the end position.

Next, if the connector 10 is moved substantially parallel from the proper position PRP to the end position ENP at the right side of FIG. 16, the projection 34 of the left restricting piece 32 remains fit in the restricting hole 11C of the left resilient piece 11B, but the projection 34 of the right restricting piece 32 comes out of the restricting hole 11C of the right resilient piece 11B. If this state is left as it is, the connector 10 is inclined to the left. Accordingly, measures are taken to prevent such a situation. Specifically, the connector 10 is provided with two auxiliary projections 20 that project towards the corresponding restricting pieces 32 at the inner sides of the restricting pieces 32, and the right auxiliary projection 20 contacts the lower horizontal surface 32B of the right restricting piece 32, as shown in FIG. 17. More specifically, the right contact surface 11A contacts the front end of the upper horizontal surface 32A of the right restricting piece 32 and the upper surface of the right auxiliary projection 20 contacts the lower horizontal surface 32B of the right restricting piece 32. Thus, the connector 10 contact the restricting piece 32 at two front and rear contact portions A3, B3 to resist a rotational moment of the connector 10 and to prevent forward and leftward inclinations of the connector 10. If the connector 10 tries to incline backward and rightward, the lower part of the inner circumferential surface of the left restricting hole 11C contacts the lower part of the outer circumferential surface of the left projection 34. Therefore backward and rightward inclinations of the connector 10 are prevented.

It goes without saying that forward, backward, left and/or right inclinations are prevented even if the connector 10 is moved parallel to the left end position, and movements at the left end position are not described since they are similar to those at the right end position.

The mounting piece 33 of the bracket 30 initially is inserted into the bracket connecting portion 14 of the connector 10. As a result, the locking piece 19 fits resiliently into the retaining hole 33E. Simultaneously, the resilient pieces 11B are deformed out in the width directions to move over the corresponding projections 34. The resilient pieces 11B then resiliently restore and the projections 34 fit into the corresponding restricting holes 11C. In this state, the first wide portion 33A is in the first accommodation space 18A, the first narrow portion 33C is between the groove portions of the first insertion groove 15, the second wide portion 33B is in the second accommodation space 18B and the second narrower portion 33D is between the groove portions of the second insertion groove 16. Further, the projections 34 are located in the corresponding restricting holes 11C and specified clearances are defined between the inner surfaces of both resilient pieces 11B and the outer surfaces of the restricting pieces 32. Therefore the connector 10 is permitted to move freely in width directions and forward and backward directions.

The environment in which the electrical component 1 is assembled into the casing R may require the electrical component 1 to be brought closer to the opening edge of the mount hole R2 while being inclined. At this time, an operator needs to assemble the electrical component 1 while holding the bracket 30, and the bracket 30 may prevent the operator from seeing the connector 10. In such cases, the connector 10 may be inclined relative to the bracket 30 and may be pushed into the mount hole R2 in an inclined posture. As a result, the leading end of the connector 10 interferes with the opening edge of the mount hole R2 and cannot be inserted into the mount hole R2.

However, the connector 10 of this embodiment cannot be inclined relative to the bracket 30. Thus, the axial center of the connector 10 can be kept substantially facing in the proper mounting direction ID (Z-axis direction) and the connector 10 can be aligned easily with the mount hole R2. Specifically, the contact surfaces 11A contact the upper horizontal surfaces 32A of the restricting pieces 32 at the front contact portions A1, A2 and the inner circumferential surfaces of the restricting holes 11C contact the outer circumferential surfaces of the projections 34 at the rear contact portions B1, B2 to prevent the connector 10 from being inclined forward and backward relative to the bracket 30 while the connector 10 is at the proper position PRP. Additionally, the contact surface 11A contacts the upper horizontal surface 32A of the restricting piece 32 at one widthwise side and the inner circumferential surface of the restricting hole 11C contact the outer circumferential surface of the projection 34 at the other widthwise side to prevent the connector 10 from being inclined in width directions relative to the bracket 30 while the connector 10 is at the proper position PRP.

The right contact surface 11A contacts the upper horizontal surface 32A of the right restricting piece 32 at the front contact portion A3 and the upper surface of the right auxiliary projection 20 contacts the lower horizontal surface 32B of the right restricting piece 32 at the rear contact portion B3 to prevent the connector 10 at the right end position from being inclined forward relative to the bracket 30. The left contact surface 11A contacts the upper horizontal surface 32A of the left restricting piece 32 and the inner circumferential surface of the left restricting hole 11C contacts the outer circumferential surface of the left projection 34 and the upper surface of the right auxiliary projection 20 contacts the right lower horizontal surface 32B to prevent the connector 10 located at the right end position from being inclined rightward relative to the bracket 30. Movements made when the connector 10 at the right end position tries to incline backward and leftward are similar to those of the connector 10 located at the proper position and hence are not described. Further, movements of the connector 10 at the left end position are similar to those of the connector 10 at the right end position and are not described.

The connector 10 can be inserted into the mount hole R2 by assembling the electrical component 1 into the casing R while substantially aligning the axial center of the connector 10 in this way. A direction of force pushing the electrical component 1 toward the casing R may be displaced from the Z-axis direction. However, the connector 10 is permitted to move freely forward, backward, leftward and rightward relative to the bracket 30 so that the direction of force can be corrected to the Z-axis. In addition, an assembling error of the connector 10 with the bracket 30 can be absorbed so that the connector 10 can be inserted smoothly into the mount hole R2.

Another part may be assembled with the bracket 30 after the connector 10 is mounted into the mount hole R2. Even in such a case, a mounting position can be adjusted finely to enable the other part to be mounted easily since the bracket 30 is freely movable forward, back, left and right relative to the connector 10.

As described above, the leading-end edges of the restricting pieces 32 contact the bottom surface of the connector 10 at the opposite widthwise sides and the leading-end edge of each restricting piece 32 contacts the connector 10 at the two front and rear contact portions A1 to A3, B1 to B3 upon inserting the connector 10 into the mount hole R2. Thus, the connector 10 cannot incline with respect to the proper mounting direction ID. Therefore, the axial center of the connector 10 can be aligned easily with the mount hole R2. The bracket 30 can be moved relative to the connector 10 in directions intersecting the proper mounting direction ID after the connector 10 is inserted into the mount hole R2. Therefore, a mounting position thereof can be adjusted finely upon mounting another part on the bracket 30.

Specifically, the upper horizontal surfaces 32A of the restricting pieces 32 of the bracket 30 contact the contact surfaces 11A of the connector 10 and the outer circumferential surfaces of the projections 34 of the restricting pieces 32 of the bracket 30 contact the inner circumferential surfaces of the restricting holes 11C of the resilient pieces 11B of the connector 10 to prevent the inclination of the connector 10. One of the inner circumferential surfaces of the restricting holes 11C is not in contact with the outer circumferential surface of the corresponding projection 34 when the connector 10 is at the end position. However, the upper surface of the auxiliary projection 20 contacts the lower horizontal surface 32B of the restricting piece 32 instead of the inner circumferential surface of the one restricting hole 11C to prevent inclination of the connector 10.

The present invention is not limited to the above described and illustrated embodiment. For example, the following modifications are also embraced by the technical scope of the present invention as claimed.

The contact surfaces 11A of the main body 11 and the inner circumferential surfaces of the restricting holes 11C contact the leading-end edge portions of the restricting pieces 32 of the bracket 30 in the above embodiment. However, projections 34 may be arranged at front and rear sides of the leading-end edge of each restricting piece 32 and may be fit in the corresponding restricting hole 11C or the projections 34 may be fit in independently formed restricting holes 11C according to the invention. In this case, by setting the dimension of the restricting holes 11C in forward and backward directions longer than a distance between the projections 34, free forward and backward movements of the connector 10 can be ensured.

The connector 10 is supported to be loosely movable relative to the bracket 30 by mounting the mounting piece 33 of the bracket 30 into the bracket connecting portion 14 of the connector 10 in the above embodiment. However, the mounting piece 33 and the bracket connecting portion 14 may be not provided. In other words, the contact surfaces 11A of the main body 11 and the inner circumferential surfaces of the restricting holes 11C may function as the bracket connecting portion 14 and the leading-end edges of the restricting pieces 32 may function as the mounting piece 33.

Although the both resilient pieces 11B are arranged at the outer sides of the corresponding restricting pieces 32 in width directions in the above embodiment, they may be arranged at the inner sides of the corresponding restricting pieces 32 in width directions according to the present invention.

Although the auxiliary projections 20 are provided on the connector 10 in the above embodiment, they may be provided on the bracket 30. Similarly, although the projections 34 are provided on the bracket 30 in the above embodiment, they may be provided on the resilient pieces 11B of the connector 10 and contact surfaces, which can contact these projections, may be provided on the leading-end edges of the restricting pieces 32 of the bracket 30.

In the above embodiment, one projection 34 comes out of the restricting hole 11C when the connector 10 is moved to the end position. However, the both projections 34 may be kept in the corresponding restricting holes 11C even when the connector 10 is moved to the end position. In this case, the auxiliary projections 20 may not be provided.

What is claimed is:

1. An electrical component for connection at a specified position of a mating member, the electrical component comprising: a connector; and a support loosely movably supporting the connector into the mating member, the support being configured to prevent loose movements of the connector until immediately before the connector is mounted at the specified mounting position while permitting loose movements of the connector in the course of mounting the connector at the specified position, wherein the support includes at least one mounting piece insertable into an insertion groove formed in the connector in a Z-direction, wherein the Z-direction is a mounting direction of the connector toward the specified mounting position, the support supporting the connector so that the connector is movable between a restricted position where loose movements of the connector are prevented and a permitted position where loose movements of the connector are permitted.

2. The electrical component of claim 1, wherein a surrounding wall forming at least part of the insertion groove includes an X-direction restricting wall that can contact substantially opposite sides of the mounting piece in an X-direction at the restricted position when the X-direction is a direction intersecting with the Z-direction in a plate surface direction of the mounting piece.

3. The electrical component of claim 2, wherein a surrounding wall forming at least part of the insertion groove includes a Y-direction restricting wall that can contact at least one side of the mounting piece in a Y-direction at the restricted position when the Y-direction is defined to be a plate surface direction of the mounting piece.

4. The electrical component of claim 3, wherein: the connector includes at least one lock displaceable in a plate surface direction of the mounting piece, and the mounting piece includes a first retaining portion for retaining the connector in the Z-direction by engaging the lock at the restricted position and a second retaining portion for retaining the connector in the Z-direction while permitting loose movements of the connector by engaging the lock at the permitted position.

5. The electrical component of claim 1, wherein:

the connector has a Z-axis extending parallel to an axial center of the connector mounted at the specified mounting position, the support includes inclination preventing portions for contacting contact portions of the connector, and the inclination preventing portions permit the connector to move along a plane intersecting the Z-axis while preventing the axial center of the connector from being inclined with respect to the Z-axis.

6. The electrical component of claim 5, wherein the inclination preventing portions are spaced apart in a direction intersecting a direction connecting the contact portions.

7. The electrical component of claim 6, wherein the support includes at least one mounting piece loosely movably supporting the connector and two restricting pieces arranged at the mounting piece to preferably face each other at substantially opposite sides of the mounting piece.

8. The electrical component of claim 7, wherein the inclination preventing portions are provided at leading-end edges of the restricting pieces and are defined by leading-end outer peripheral edges of the restricting pieces and outer circumferential surfaces of projections projecting sideways from the leading-end edges of the both restricting pieces.

9. The electrical component of claim 8, wherein the connector includes contact surfaces that can contact the leading-end outer peripheral edges of the restricting pieces, two resilient pieces projecting from the corresponding contact surfaces and arranged to face the corresponding restricting pieces, and two restricting holes penetrating the corresponding resilient pieces and having inner circumferential surfaces that can contact the outer circumferential surfaces of the corresponding projections.

10. The electrical component of claim 9, wherein:

the connector (10) is movable in width directions relative to the support between a proper position and an end position, one of the inner circumferential surfaces of the restricting holes is not in contact with the outer circumferential surface of the corresponding projection when the connector is at the end position.

11. The electrical component of claim 10, wherein two auxiliary projections are provided at the substantially opposite widthwise sides for contacting the leading-end outer peripheral edge of the restricting piece instead of the inner circumferential surface of the one restricting hole.

12. An electrical component for connection with of a mating member at a specified position, comprising:

a connector configured for connection with the mating member by moving the connector along a mounting direction when the connector is aligned properly with the specified position of the mating member; and a support movable along the mounting direction toward the mating member, the support being engaged with the connector for movement between a restricted position where loose movements of the connector relative the support in directions transverse to the mounting direction are prevented and a permitted position where loose movements of the connector in directions transverse to the mounting direction are permitted, whereby the support and the connector are moved to the permitted position immediately before the connector reaches the specified mounting position so that the connector can move relative to the support and the specified position in directions transverse to the mounting direction and into proper alignment with the specified position of the mating member wherein the connector includes an insertion groove extending in the mounting direction and the support includes a mounting piece insertable into the insertion groove in the mounting direction, the insertion groove being configured relative to the mounting piece to define the restricted position where loose movements of the connector transverse to the mounting direction are prevented and the permitted position where loose movements of the connector transverse to the mounting direction are permitted.

13. The electrical component of claim 12, wherein the connector includes at least one resiliently displaceable lock and wherein the mounting piece includes a first retaining portion for releasably engaging the lock for holding the connector at the restricted position-(P) and a second retaining portion for releasably engaging the lock for holding the connector at the permitted position.

14. An electrical component for connection with of a mating member at a specified position, comprising:

a connector configured for connection with the mating member by moving the connector along a mounting direction when the connector is aligned properly with the specified position of the mating member; and a support movable along the mounting direction toward the mating member, the support being engaged with the connector for movement between a restricted position where loose movements of the connector relative the support in directions transverse to the mounting direction are prevented and a permitted position where loose movements of the connector in directions transverse to the mounting direction are permitted, whereby the support and the connector are moved to the permitted position immediately before the connector reaches the specified mounting position so that the connector can move relative to the support and the specified position in directions transverse to the mounting direction and into proper alignment with the specified position of the mating member, wherein:

the connector has a Z-axis extending parallel to an axial center of the connector mounted at the specified mounting position, the support includes inclination preventing portions for contacting contact portions of the connector, and the inclination preventing portions permit the connector to move along a plane intersecting the Z-axis while preventing the axial center of the connector from being inclined with respect to the Z-axis.

* * * * *